US006565612B2

(12) United States Patent
Payet et al.

(10) Patent No.: US 6,565,612 B2
(45) **Date of Patent: *May 20, 2003**

(54) SHRINK RESISTANT RAYON FABRICS

(75) Inventors: George L. Payet, Cincinnati, OH (US); Michelle F. Mellea, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 61 days.

This patent is subject to a terminal disclaimer.

(21) Appl. No.: 09/732,841

(22) Filed: Dec. 8, 2000

(65) Prior Publication Data

US 2001/0052193 A1 Dec. 20, 2001

Related U.S. Application Data

(63) Continuation-in-part of application No. 09/539,088, filed on Mar. 30, 2000, now abandoned, which is a continuation-in-part of application No. 09/163,319, filed on Sep. 30, 1998.

(51) Int. Cl.[7] ..... D06M 13/12; B32M 3/18; B32M 5/00; B32M 27/02; B32M 27/16

(52) U.S. Cl. ..... 8/116.4; 8/181; 8/183; 8/116.1; 442/59; 442/87; 442/99; 442/106; 442/109; 442/152; 442/153

(58) Field of Search ..... 8/116.4, 181, 183, 8/116.1; 442/59, 87, 99, 106, 109, 152, 153

(56) References Cited

U.S. PATENT DOCUMENTS

| | | | | | |
|---|---|---|---|---|---|
| 2,243,765 | A | | 5/1941 | Morton | 260/212 |
| 3,420,696 | A | * | 1/1969 | Cotton et al. | 117/118 |
| 3,646,015 | A | | 2/1972 | Hamilton | 260/240 |
| 3,663,974 | A | * | 5/1972 | Watanabe et al. | 8/116.4 |
| 3,731,411 | A | | 5/1973 | Barber et al. | 38/144 |
| 3,807,952 | A | | 4/1974 | Lauchenauer | 8/186 |
| 3,811,834 | A | | 5/1974 | Schwemmer et al. | 8/116 R |
| 3,837,799 | A | | 9/1974 | Wilson et al. | 8/115.6 |
| 3,841,832 | A | | 10/1974 | Swidler et al. | 8/116.4 |
| 3,865,545 | A | | 2/1975 | Forg et al. | 8/116 R |
| 3,960,482 | A | | 6/1976 | Payet | 8/116.4 |
| 3,960,483 | A | | 6/1976 | Payet | 8/116.4 |
| 3,980,429 | A | | 9/1976 | Lawrence et al. | 8/125 |
| 4,067,688 | A | | 1/1978 | Payet | 8/116.4 |
| 4,072,466 | A | | 2/1978 | Hermann | 8/183 |
| 4,104,022 | A | | 8/1978 | Payet | 8/115.6 |
| 4,108,598 | A | | 8/1978 | Payet | 8/115.7 |
| 4,184,004 | A | | 1/1980 | Pines et al. | 428/413 |
| 4,312,993 | A | | 1/1982 | Martin | 556/419 |
| 4,331,797 | A | | 5/1982 | Martin | 528/26 |
| 4,396,390 | A | | 8/1983 | Hendrix et al. | 8/116.4 |
| 4,475,917 | A | | 10/1984 | Ohshima et al. | 8/127 |
| 4,520,176 | A | * | 5/1985 | Martin et al. | 524/598 |
| 4,530,874 | A | | 7/1985 | Hendrix et al. | 428/266 |
| 4,619,864 | A | | 10/1986 | Hendrix et al. | 428/240 |
| 4,790,856 | A | | 12/1988 | Wixon | 8/137 |
| 5,021,264 | A | | 6/1991 | Kästele et al. | 427/353 |
| 5,458,544 | A | | 10/1995 | Fujiwara et al. | 474/205 |
| 5,480,485 | A | | 1/1996 | McClain et al. | 118/64 |
| 5,879,410 | A | | 3/1999 | Yanai et al. | 8/181 |
| 5,885,303 | A | | 3/1999 | Payet | 8/116.4 |
| 6,375,685 | B2 | * | 4/2002 | Payet | 8/116.4 |

FOREIGN PATENT DOCUMENTS

| | | |
|---|---|---|
| CH | 557447 | 7/1974 |
| WO | WO9500697 | 1/1995 |
| WO | WO9910589 | 3/1999 |
| WO | WO9958758 | 11/1999 |

OTHER PUBLICATIONS

Isharani, *Book of Papers,* "Ultratex–New Breed of Textile Finish," 144–153 (Oct. 1982).
Carr, Editor, *Chemistry of the Textiles Industry,* 271–272 (1995) No Month Given.

* cited by examiner

*Primary Examiner*—Yogendra N. Gupta
*Assistant Examiner*—Brian P. Mruk
(74) *Attorney, Agent, or Firm*—Dinsmore & Shohl

(57) ABSTRACT

Fabrics containing rayon fibers may exhibit, after the fabric has been aqueous laundered at least one time, changes in dimension in length and in width of less than about 5% each, a durable press value of at least about 2.5, and a water absorbency time of less than about 100 seconds. Fabrics containing rayon fibers may also exhibit, after the fabric has been aqueous laundered at least one time, changes in dimension in length and in width of less than about 8% each, a durable press value of at least about 3.5, and a water absorbency time of less than about 100 second.

53 Claims, No Drawings

SHRINK RESISTANT RAYON FABRICS

RELATED APPLICATIONS

The present application is a continuation-in-part of application Ser. No. 09/539,088, filed Mar. 30, 2000, now abandoned which is a continuation-in-part of application Ser. No. 09/163,319, filed Sep. 30, 1998.

TECHNICAL FIELD

This invention relates to rayon fabrics. More particularly, the invention relates to fabrics comprising rayon fibers which have a combination of good durable press properties, good dimensional stability and good water absorption. The invention also relates to fabrics comprising rayon fibers which may be subjected to aqueous laundering.

BACKGROUND OF THE INVENTION

Many fabrics, particularly fabrics comprising natural fibers, do not possess durable press (or "wash and wear" or "smooth-dry") performance or dimensional stability, i.e., shrinkage resistance. Cellulosic fabrics such as cotton have been treated with aminoplast resins, including N-methylol cross-linking resins such as dimethylol dihydroxyethyleneurea (DMDHEU) or dimethylol propylcarbamate (DMPC), to impart durable press properties, as disclosed, for example, in the Martin et al U.S. Pat. No. 4,520,176. Unfortunately, many reacted aminoplast resins break down during storage, thus releasing formaldehyde. The formaldehyde release may occur not only throughout the preparation of the fabric but also during garment-making. Further, garments or fabrics treated with aminoplast resins may release additional formaldehyde when stored under humid conditions. Aminoplast resins may also hydrolyze during washing procedures, resulting in a loss of the durable press performance, and tend to give fabric a harsher handle, that is, make the fabric feel less soft. The fabric is often treated with additional softeners, for example silicone softeners. Unfortunately, the silicone softeners tend to make fabric hydrophobic although it is often preferred that the fabric have hydrophilic properties.

Cellulosic fibers have also been cross-linked with formaldehyde to impart durable press properties. For example, the Payet U.S. Pat. Nos. 3,960,482, 3,960,483, 4,067,688 and 4,104,022 disclose durable press processes which comprise impregnating a cellulosic fiber-containing fabric with an aqueous solution comprising a catalyst, and, while the fabric has a moisture content of above 20% by weight, exposing the fabric to formaldehyde vapors and curing under conditions at which formaldehyde reacts with the cellulose. The Payet U.S. Pat. No. 4,108,598 discloses a process which comprises treating cellulosic fiber-containing fabrics with an aqueous solution of formaldehyde and a catalyst, heat curing the treated fabric by introducing the fabric into a heating zone, and gradually increasing the temperature of the heating zone, thereby increasing the temperature of the heated fabric to prevent the loss of an amount of formaldehyde which will reduce the overall extent of curing. The Payet U.S. Pat. No. 5,885,303 also discloses a durable press process for cellulosic fiber-containing fabrics. The process comprises treating the fabric with an aqueous solution of formaldehyde, a catalyst capable of catalyzing the cross-linking reaction between formaldehyde and cellulose, and an effective amount of a silicone elastomer to reduce loss in tear strength in the treated fabric. Formaldehyde is generally less expensive than aminoplast resins, and formaldehyde treatment of cellulosic fabrics typically results in durable press properties which are more durable than those obtained by aminoplast resins.

Rayon garments are desirable by consumers for a variety of reasons. However, many durable press treatment processes that have been provided for cotton cellulose fabrics have not been suitable for rayon fabrics. Although rayon and cotton are both cellulose fibers, they react very differently from one another. Particularly, rayon-containing fabrics exhibit significant shrinkage when subjected to aqueous washing or laundering and therefore generally require dry cleaning as opposed to washing in an aqueous environment.

The copending Payet application Ser. No. 09/163,319 discloses processes for providing rayon fabrics with durable press properties wherein a rayon fiber-containing fabric is treated with an aqueous mixture containing a high concentration of formaldehyde and a catalyst capable of catalyzing the cross-linking reaction between formaldehyde and the rayon, and the treated fabric is heat cured. Payet discloses that the fabric may be washed or laundered in an aqueous system and does not shrink substantially on aqueous washing. Additionally, a silicone elastomer may be employed to reduce loss in tear and tensile strength in the treated fabric.

An important feature of cellulose fabrics, both cotton and rayon particularly, is that they are naturally hydrophilic, and therefore absorb moisture. Typically, garments made of fabrics which are hydrophilic are more comfortable for wear and therefore are preferred by consumers over garments which are formed of hydrophobic, non-moisture absorbing fabrics. However, many conventional fabric treatments for improving durable press and/or for reducing shrinkage of cellulose fabrics, and particularly for cotton and rayon fabrics, inhibit the natural water absorbency of the cellulose fibers and render the fabrics hydrophobic. Such fabrics are therefore not preferred for garment use owing to their reduced ability or substantial inability to absorb moisture.

Accordingly, there is a continuing need to further improve individual characteristics of fabrics comprising rayon fibers, and to improve the overall combinations of properties exhibited by such fabrics.

SUMMARY OF THE INVENTION

Accordingly, it is an object of this invention to obviate various problems of the prior art and to provide improved fabrics comprising rayon fibers. It is also an object of this invention to provide for fabrics comprising rayon fibers which have a combination of good durable press properties, good dimensional stability, and good water absorption. It is another object of this invention to provide for rayon fabrics having a durable press property which is maintained after repeated aqueous launderings.

In accordance with one aspect of the invention there are provided fabrics comprising rayon fibers and exhibiting, after the fabric has been aqueous laundered at least one time, changes in dimension in length and in width of less than about 5% each, a durable press value of at least about 2.5, and a water absorbency time of less than about 100 seconds. In accordance with another aspect of the invention there are provided fabrics comprising rayon fibers and exhibiting, after the fabric has been aqueous laundered at least one time, changes in dimension in length and in width of less than about 8% each, a durable press value of at least about 3.5, and a water absorbency time of less than about 100 seconds.

In accordance with one aspect of the invention there are provided methods of laundering a fabric comprising rayon fibers comprising the steps of aqueous laundering and drying. The fabrics exhibit, after at least one cycle of aqueous laundering and drying, changes in dimension in length and in width of less than about 5% each.

In accordance with one aspect of the invention there are provided treated fabrics comprising rayon fibers which after at least one aqueous laundering exhibits, as compared to untreated fabric having the same fiber composition, changes in dimension in length and in width which are each at least about 25% less than that exhibited by the untreated fabric, a durable press value at least about 0.5 unit greater than that exhibited by the untreated fabric, and a water absorbency time of less than about 100 seconds.

In accordance with one aspect of the invention there are provided fabrics comprising rayon fibers selected from the group consisting of fabrics comprising no less than about 50% rayon fibers and exhibiting, after the fabric has been aqueous laundered at least one time, a total shrinkage of less than about 5% and a durable press value of at least about 3.5; fabrics comprising no less than about 85% rayon fibers and exhibiting, after the fabric has been aqueous laundered at least one time, a total shrinkage of less than about 10% and a durable press value of at least about 3; and fabrics comprising about 100% rayon fibers and exhibiting, after the fabric has been aqueous laundered at least one time, a total shrinkage of no more than about 12% and a durable press value of at least about 3.

In accordance with one aspect of the invention there are provided fabrics comprising about 50% rayon fibers and about 50% acetate fibers and exhibiting, after the fabric has been aqueous laundered at least one time, a total shrinkage of less than about 40%, preferably less than about 20%, more preferably less than about 15%.

These and additional aspects, objects and advantages of the invention are more fully described in the detailed description.

DETAILED DESCRIPTION OF THE INVENTION

Although some fabrics containing rayon fiber exhibit good dimensional stability or durable press properties or water absorbency, conventional rayon fabrics fail to provide the combination of good dimensional stability, good durable press and good water absorbency simultaneously. In contrast, fabrics in accordance with the present invention comprise rayon fibers and simultaneously exhibit good dimensional stability, good durable press and good water absorbency. Fabrics in accordance with the present invention further exhibit good strength.

As used herein, "individual fiber" refers to a short and/or thin strands, such as short strands of cotton as obtained from the cotton boll, short strands of wool as sheared from the sheep, strands of cellulose or rayon, or the thin strands of silk obtained from a silkworm cocoon. As used herein, "fibers" is intended to include strands in any form, including individual strands, and the strands present in formed yarns, fabrics and garments. Fibers include filaments and staple fibers. As used here, "filaments" refer to long continuous fibers that may be measured in meters or yards. Filaments generally do not require spinning to form yarns, and may include synthetic filaments such as rayon, nylon, acrylic and polyester, as well as natural filaments such as silk. As used here, "staple fibers" refer to short fibers that may be measured in inches or fractions of inches. The staple fibers generally require spinning to obtain a length sufficient for knitting or weaving. Staple fibers may include natural staple fibers such as wool and cotton, and may also include synthetic staples such as rayon, nylon, acrylic and polyester.

As used herein, "yarn" refers to a product obtained when fibers are comingled and twisted. Yarns are products of substantial length and relatively small cross-section. Yarns may be formed by spinning staple fibers or filaments. Yarns may be single ply yarns, that is having one yarn strand, or multiple ply yarns, such as 2-ply yarn which comprises two single yarns twisted together or 3-ply yarn which comprises three yarn strands twisted together.

As used herein, "fabrics" generally refer to knitted fabrics, woven fabrics, or non-woven fabrics prepared from yarns or individual fibers, while "garments" generally refer to wearable articles comprising fabrics, including, but not limited to, shirts, blouses, dresses, pants, sweaters and coats. Non-woven fabrics include fabrics such as felt and are composed of a web or batt of fibers bonded by the application of heat and/or pressure and/or entanglement and/or adhesives. "Textiles" includes fabrics, yarns, and articles comprising fabrics and/or yarns, such as garments, home goods, including, but not limited to, bed and table linens, draperies and curtains, and upholsteries, and the like.

As used herein, "natural fibers" refer to fibers which are obtained from natural sources, such as cellulosic fibers and protein fibers, or which are formed by the regeneration of or processing of natural occurring fibers and/or products. Natural fibers are not intended to include fibers formed from petroleum products. Natural fibers include fibers formed from cellulose, such as cotton fiber and regenerated cellulose fiber, commonly referred to as rayon, or acetate fiber derived by reacting cellulose with acetic acid and acetic anhydride in the presence of sulfuric acid. As used herein, "natural fibers" are intended to include natural fibers in any form, including individual strands, and fibers present in yarns, fabrics and other textiles, while "individual natural fibers" is intended to refer to individual natural strands.

As used herein, "cellulosic fibers" are intended to refer to fibers comprising cellulose, and include, but are not limited to, cotton, linen, flax, rayon, cellulose acetate, cellulose triacetate, hemp and ramie fibers. As used herein, "rayon fibers" is intended to include, but is not limited to, fibers comprising viscose rayon, high wet modulus rayon, cuprammonium rayon, saponified rayon, modal rayon and lyocell rayon. "Protein fibers" are intended to refer to fibers comprising proteins, and include, but are not limited to, wools, such as sheep wool, alpaca, vicuna, mohair, cashmere, guanaco, camel and llama, as well as furs, suedes, and silks.

As used herein, "synthetic fibers" refer to those fibers which are not prepared from naturally occurring strands and include, but are not limited to, fibers formed of synthetic materials such as polyesters, polyamides such as nylons, polyacrylics, and polyurethanes such as spandex. Synthetic fibers include fibers formed from petroleum products.

As used herein, "aqueous laundering" is intended to refer to laundering fabric with a composition comprising water and, generally, detergent, and includes home laundering, coin-operated laundering, and commercial laundering. Laundering may be done by machine or by hand.

The fabrics comprise rayon fibers which may be included in any form, including, but not limited to, in the form of individual fibers (for example in non-woven fabrics), or in the form of yarns comprising rayon fibers, woven or knitted to provide the fabrics. Additionally, the fabrics may be in the form of garments or other textiles comprising rayon fibers. In one embodiment the fabrics comprise no less than about 50%, preferably no less than about 65%, more preferably no less than about 75%, even more preferably no less than 85%, and most preferably 100%, rayon fibers. In another embodiment the fabrics comprise greater than about 20% rayon fibers, preferably greater than about 50% rayon fibers, and more preferably greater than about 80% rayon fibers. The fabrics comprising the rayon fibers may be aqueous laundered. Importantly, although the fabrics may be line-dried or dried while flat, it is also possible to machine tumble dry the fabrics while still maintaining good dimensional stability and durable press property.

Fabrics for use in the present invention may further comprise synthetic fibers or natural fibers other than rayon, which fibers may be included in any form, including, but not limited to, in the form of individual fibers (for example in non-woven fabrics), or in the form of yarns comprising the fibers, woven or knitted to provide the fabrics. Preferably, the fabrics comprise at least about 20%, preferably at least about 50%, more preferably at least about 80%, total natural fibers. In another embodiment, the fabrics comprise 100% rayon and any other natural fibers. Preferred natural fibers other than rayon are selected from the group consisting of cellulosic fibers, such as cotton, linen, flax, cellulose acetate, cellulose triacetate, and ramie fibers, while preferred synthetic fibers are selected from the group consisting of polyesters, polyamides, polyacrylics, and polyurethanes.

As used herein, dimensional stability refers to the ability of a fabric to maintain its original dimensions after laundering. Woven fabric may shrink, while knits may shrink and/or stretch out of shape. A common measurement of dimensional stability is shrinkage in the length and width direction of a fabric swatch, in accord with the method described in AATCC Test Method 135-1995. Shrinkage may also be evaluated according to AATCC Test Method 150-1995. Fabrics in accordance with the invention exhibit after at least one, preferably at least five, aqueous launderings a change in dimension of less than about 10%, preferably less than about 8%, more preferably less than about 5%, and even more preferably less than about 4%, and most preferably less than about 2%, in length and width each. In a preferred embodiment fabrics, preferably woven fabrics, comprise rayon fibers and exhibit, after at least one aqueous laundering, a change in dimension of less of than about 5%, preferably less than about 3%, more preferably less than about 2%, and even more preferably less than about 1%, in length and in width each.

In one embodiment after at least one aqueous washing fabrics comprising about 65% rayon fibers and about 35% wool fibers exhibit a shrinkage in length and in width of less than 10%, preferably less than 6%, each, while fabrics comprising about 50% cotton and about 50% rayon exhibit a shrinkage in length and in width of less than about 3% each. In another embodiment after at least one aqueous washing fabrics comprising 100% rayon fibers exhibit a shrinkage in length and in width of less than about 3%, preferably less than about 2%, even more preferably no greater than about 1%, each, while fabrics comprising about 50% rayon and about 50% polyester exhibit a shrinkage in length and in width of less than about 1% each, and fabrics comprising about 85% rayon and about 15% flax exhibit a shrinkage in length and in width of less than about 4%, preferably less than about 2%.

Preferably after 5 aqueous launderings fabrics comprising rayon fibers exhibit a shrinkage in length and in width of less than about 5%, preferably less than about 4%, more preferably less than about 3%, each, while after 25 aqueous launderings the fabrics exhibit a shrinkage in length and in width of no greater than about 6%, preferably less than about 5%, more preferably less than about 4%, each.

Dimensional stability may also be determined based on total shrinkage, that is, the total of the percentage of shrinkage in width and the percentage of shrinkage in length. Generally the total shrinkage of fabrics in accordance with the invention will be less than about 10%, preferably less than about 8%, more preferably less than about 4%, even more preferably less than about 3%, and most preferably less than about 2%, after at least one aqueous laundering.

In one embodiment after at least one aqueous laundering fabrics comprising no less than about 50% rayon fibers exhibit a total shrinkage of less than about 6%, while fabrics comprising no less than about 85% rayon fibers exhibit a total shrinkage of less than about 10%, and fabrics comprising 100% rayon fibers exhibit a total shrinkage of no more than about 12%. Fabrics comprising a blend of flax fibers and no less than 85% rayon fibers preferably exhibit, after at least one aqueous laundering, a total shrinkage of less than about 6%, preferably less than about 5%, while fabrics comprising polyester fibers and no less than 50% rayon fibers exhibit, after at least one aqueous laundering, a total shrinkage of less than about 3%, preferably less than about 2%, and fabrics comprising cotton fibers and no less than about 50% rayon fibers exhibit, after at least one aqueous laundering, a total shrinkage of less than about 5%, preferably less than about 4%. In another embodiment, after one aqueous laundering, fabrics comprising about 65% rayon fibers and about 35% wool fibers exhibit a total shrinkage of less than about 15%, preferably less than about 10%, and more preferably less than about 5%, while fabrics comprising about 50% rayon and about 50% acetate exhibit a total shrinkage of less than about 40%, preferably less than about 20%, more preferably less than about 10%. In one embodiment of the invention there are provided fabrics comprising about 50% rayon fibers and about 50% acetate fibers and exhibiting, after the fabric has been aqueous laundered at least one time, a total shrinkage of less than about 40%, preferably less than about 20%, more preferably less than about 15%.

A common evaluation of a fabric's durable press property is the smoothness exhibited by fabrics after washing, in accordance with AATCC Test Method 124-1996. Fabrics in accordance with the invention exhibit after at least one, preferably at least five, aqueous launderings and dryings, preferably machine dryings, a durable press value of at least about 2.5, preferably at least about 3, more preferably at least about 3.25, even more preferably at least about 3.5, and most preferably at least about 4.5. In one preferred embodiment after at least one aqueous laundering and drying, preferably by machine tumble drying, the fabric, preferably a woven fabric, exhibits a durable press value of at least about 3, more preferably at least about 3.5, even more preferably at least about 4 and most preferably about 5.

Fabrics in accordance with the invention exhibit good durable press properties even after more than one aqueous launderings. In one embodiment, after 5 aqueous laundering and dryings, preferably machine dryings, fabrics in accordance with the invention exhibit a durable press value of no less than about 3, preferably no less than about 3.5, more preferably no less than about 4; after 10 aqueous launderings and dryings, preferably machine dryings, the fabrics exhibit a durable press value of no less than about 2.5, preferably no less than about 3, more preferably no less than about 3.5; and after 25 aqueous launderings and dryings, preferably machine dryings, the fabrics exhibit durable press value of at least about 2, preferably at least about 3, more preferably at least about 3.5. In one embodiment the fabrics comprise at least about 50% rayon and after 25 aqueous launderings and dryings, preferably machine dryings, has a durable press value of at least about 3, preferably at least about 3.5.

Knitted fabrics and knitted garments, such as sweaters, are often designed to be textured, or to drape over an individual's body. Thus, although it is desirable that knits exhibit good dimensional stability and resistance to shrinkage, a knitted garment's durable press property may be of less interest to consumers than the garment's tendency to torque when laundered. As used herein, torque refers to the tendency for knitted fabrics to twist or to develop some degree of skewness. Knitted fabrics in accordance with the invention exhibit good torque, and generally exhibit a torque of less than about 5%, preferably less than about 4%, as measured according to AATCC 179-1996. In one embodiment, a knitted fabric comprising rayon fibers has a durable press value of a least about 2.5, preferably greater than about 2.5, in combination with a torque of less than about 5%, preferably less than about 4%, more preferably less than about 3%.

Fabrics in accordance with the invention also exhibit good water absorbency. As employed in the present invention, good water absorbency indicates that the fabric absorbs a drop of water placed thereon, in accord with the methods described in AATCC Method 79-1995, in less than about 100 seconds. Generally the fabrics have an absorbency of less than about 100, preferably less than about 80, more preferably less than about 30, even more preferably less than about 20, and more preferably still less than about 10, seconds.

In a more specific embodiment, the fabrics according to the present invention exhibit a water absorbency time of less than about 100 seconds, preferably less than about 80 seconds, and even more preferably less than about 60 seconds, and more preferably still less than about 30 second, even after the fabric has been aqueous laundered at least once. In another embodiment, the fabrics according to the present invention exhibit a water absorbency time of less than about 20 seconds, preferably less than about 10 seconds, even after the fabric has been aqueous laundered at least once.

One skilled in the art will appreciate that various fabric preparation processes may involve application of a wetting agent to the fabric. Typically, wetting agents may be employed to improve wet pick-up of chemistry during fabric finishing. The water absorbency properties as disclosed herein are exhibited by the fabric after any such wetting agent has been removed, for example by laundering or the like. Thus, the good water absorbency properties are maintained after one or more washings or launderings of the fabrics. The good water absorbency properties are particularly advantageous when the fabric is used in garment manufacture, as garments which absorb moisture are generally more comfortable for wear and therefore are preferred by consumers over garments which are formed of hydrophobic, non-moisture absorbing fabrics.

Preferably the fabrics exhibit not only good dimensional stability and durable press property, but also adequate strength. Woven fabrics in accordance with the invention exhibit good filling tensile and filling tear strengths of, for example, at least about 20, preferably at least about 25, more preferably at least about 30, pounds and at least about 1, preferably at least about 1.5, pounds, respectively. Tensile strength may be measured according to method ASTM D5035-90, while tear strength may be measured according to method ASTM D2261-96. Knitted fabrics in accordance with the invention exhibit adequate burst strength, such as a burst strength of at least about 70, preferably at least about 80, more preferably at least about 85, and even more preferably at least about 90, pounds. Burst strength may be measured according to test method ASTM D3787-89 or ASTM D3887-96.

While some consumers consider the softness of a fabric to be the tendency of the fabric to be flexible as opposed to stiff, other consumers consider softness as the tendency of a fabric to feel smooth to the touch as opposed to rough. Softness may be measured using commercially available softness testers such as the TRI Softness Tester. The roughness of a fabric may be measured by determining its coefficient of friction; the KES MIU value, an indication of the coefficient of friction and may be measured using commercially available friction testers such as the Kawabata Evaluation System KES-SE Friction Tester. Preferably fabrics in accordance with the invention, as measured with a TRI Softness Tester, have a softness reading of at least about 8, preferably greater than about 8, more preferably greater than about 10. Generally, fabrics in accordance with the invention have a KES MIU value, as measured using a Kawabata Evaluation System KES-SE Friction Tester, of no greater than about 1.3, preferably no greater than about 1.2.

In one embodiment, the fabric comprises 100% rayon, and has a softness value of at least about 10. In another embodiment, fabrics comprising rayon fibers exhibit a softness value of at least about 8, as measured using an Instron TRI Softness Tester, and, after at least one washing, a durable press value of at least about 3, while in another embodiment fabrics comprising rayon fibers exhibits a softness value of at least about 10 and a durable press value of at least about 2, in combination with a water absorbency of less than about 300, and a total shrinkage of less than about 2%.

As used herein "treated rayon fibers" refers to fibers which have been subjected to a treatment in order to improve the dimensional stability and/or durable press property of fabric comprising such fibers. As will be apparent to one of skill in the art, fabrics may be prepared with differing levels of treated rayon fibers. The respective levels of treated rayon fibers and of fibers other than the treated rayon fibers may be adjusted to obtain desired combinations of durable press properties, dimensional stability, water absorption, softness, and/or coefficient of friction.

One fabric in accordance with the invention comprises rayon fibers and cellulosic fibers other than rayon and exhibits, after the fabric has been aqueous laundered at least once, a length shrinkage and a width shrinkage of less than about 5%, preferably less than about 4%, each, and a durable press value of at least about 3, preferably at least about 3.5. The fabric has a water absorbency of less than about 100, preferably less than about 80, more preferably less than about 30, and even more preferable less than about 10, seconds. Preferably the cellulosic fibers are selected from the group consisting of cotton, flax, linen, acetate, triacetate and mixtures thereof.

Another fabric in accordance with the invention comprises synthetic fibers and no less than about 50%, preferably no less than about 65%, by weight, rayon fibers and exhibits, after the fabric has been aqueous laundered at least once, a length shrinkage and a width shrinkage of less than about 3%, preferably less than about 2%, each, and a durable press value of at least about 3.5, preferably of at least about 4. The fabric has a water absorbency of less than about 100, preferably less than about 80, more preferably less than about 30 seconds.

In one embodiment the fabric comprises no less than about 50% rayon fibers and exhibits, after the fabric has been aqueous laundered at least once, a total shrinkage of less than about 5%, preferably less than about 3%, a durable press value of at least about 3.5, preferably at least about 4, and a water absorbency time of less than about 100 seconds.

In another embodiment the fabric comprises no less than about 85% rayon fibers and exhibits, after the fabric has been aqueous laundered at least one time, a total shrinkage of less than about 10%, preferably less than about 6%, a durable press value of at least about 3, preferably at least about 3.5, and a water absorbency time of less than about 100 seconds.

In yet another embodiment the fabric comprises about 100% rayon fibers and exhibits, after the fabric has been aqueous laundered at least one time, a total shrinkage of less than about 10%, a durable press value of at least about 3, and a water absorbency time of less than about 100 seconds.

In one embodiment the fabric comprises about 50% by weight rayon fibers and about 50% by weight acetate fibers, and exhibits, after one aqueous washing, a total shrinkage of less than about 40%, preferably less than about 20%, more preferably less than about 10%, and a durable press value of at least about 2.5, preferably at least about 3.

As used herein "treated fabric" refers to a fabric which has been subjected to a treatment in order to improve the fabric's dimensional stability and/or durable press property. Suitable treatments include, but are not limited to, mechanical treatments, such as compression, and chemical treatments. The fabric may be fabric which is treated after being woven or knitted, or may be a finished garment, such as a shirt, which is treated after it has been sewn. "Untreated fabric" refers to fabric which has not been subjected to such a treatment.

Fabrics comprising rayon fibers may be treated such that, after at least one cycle of aqueous laundering and drying, preferably machine drying, the fabrics exhibit a change in dimension in each of length and width of at least about 25% less, preferably at least about 35% less, more preferably at least about 50% less, and even more preferably at least about 75% less, than that exhibited by untreated fabrics having the same fiber composition, and a durable press value at least about 0.5 unit greater, preferably at least about 0.7 unit greater, more preferably at least about 1 unit greater, even more preferably at least about 1.5 units greater, than that exhibited by untreated fabrics having the same fiber composition. In one embodiment treated fabrics, when washed and line dried at last once, exhibit a durable press property about as great as, preferably greater than, untreated fabrics having the same fiber content, and when washed and machine dried at least once exhibit a durable press value at least about 1, preferably at least about 2, units greater than that exhibited by untreated fabrics having the same fiber composition. The treated fabrics exhibit good water absorbency of less than about 100, preferably less than about 80, more preferably less than about 30, even more preferably less than about 10, seconds. In one embodiment the treated fabric exhibits a softness value, as measured using a TRI Softness Test, of at least about as great as, preferably greater than, that exhibited by untreated fabrics.

One preferred chemical treatment is treatment with formaldehyde and catalyst. While not being bound by theory, it is believed that when natural fibers such as rayon are treated with a composition comprising formaldehyde and a catalyst capable of cross-linking formaldehyde with a natural fiber, a chemical modification of the natural fibers occurs. It is believed that the formaldehyde reacts chemically with the natural fibers to cross-link the individual polymer chains of the natural fibers, and establish the durable press properties and/or dimensional stability, i.e., reduced shrinkage. In accordance with the present invention, a silicone elastomer or precursor thereof is included in the formaldehyde treatment. The fabrics surprisingly exhibit good water absorbency, good durable press property, good dimensional stability, and preferably also exhibit good strength, for example good tear and tensile strengths.

In one embodiment of the invention, to provide the cross-linked formaldehyde treatment, the fabric is typically treated with a treatment composition comprising formaldehyde, a catalyst and a silicone elastomer or precursor thereof, followed by drying and/or curing of the treated fabric. Formaldehyde is generally available in an aqueous solution, referred to as formalin, comprising water, about 37% by weight formaldehyde, and generally about 10% to 15% by weight methanol. Formaldehyde may also be generated in an aqueous treating solution in situ by adding paraformaldehyde (polyoxymethylene) to water, thereby generating formaldehyde.

The amount of formaldehyde in the treatment composition is preferably sufficient to impart a durable press property and/or shrinkage resistance to the fabric. Generally the fabric comprising rayon fibers is treated with at least about 3% by weight formalin, preferably with from about 5% to about 40%, more preferably from about 5% to about 30% by weight formalin, based on the weight of the fabric. In one embodiment, the fabric comprises 100% rayon fibers, and is treated with from about 10% to about 40%, preferably from about 10% to about 35% formalin, based on weight of the fabric.

As used herein, "formalin" refers to an aqueous solution comprising 37%, by weight, formaldehyde. As will be apparent to one of skill in the art, formaldehyde solutions comprising levels of formaldehyde other than 37%, by weight, may also be used. Using the above ranges of formalin, the fabric comprises rayon fibers is treated with actual formaldehyde, as opposed to formalin, at a level from of at least about 1%, preferably about 1% to about 15%, more preferably about 1% to about 12%, by weight formaldehyde, as opposed to formalin, based on the weight of the fabric. In one embodiment, the fabric comprises 100% rayon fibers, and is treated with from about 3% to about 15%, more preferably from about 3% to about 13%, by weight formaldehyde.

Suitable catalysts are those capable of catalyzing a cross-linking reaction between formaldehyde and a natural fiber, and preferably are catalysts capable of catalyzing the cross-linking of formaldehyde with a natural fiber comprising hydroxy groups, such as cellulosic fibers. Catalysts which may be used include mineral acids, organic acids, salts of strong acids, ammonium salts, alkylamine salts, metallic salts and combinations thereof. In one embodiment the catalyst is other than a mineral acid.

Suitable mineral acid catalysts include hydrochloric acid, sulfuric acid, nitric acid, phosphoric acid and boric acid. Suitable organic acids include oxalic acid, tartaric acid, citric acid, malic acid, glycolic acid, methoxyacetic acid, chloroacetic acid, lactic acid, 3-hydroxybutyric acid, methane sulfonic acid, ethane sulfonic acid, hydroxymethane sulfonic acid, benzene sulfonic acid, p-toluene sulfonic acid, cyclopentane tetracarboxylic acid, butane tetracarboxylic acid, tetrahydrofuran-tetracarboxylic acid, nitrilotriacetic acid, and ethylenediaminetetraacetic acid. Suitable salts of strong acids include sodium bisulfate, sodium dihydrogen phosphate and disodium hydrogen phosphate. Suitable ammonium salts include ammonium chloride, ammonium nitrate, ammonium sulfate, ammonium bisulfate, ammonium dihydrogen phosphate and diammonium hydrogen phosphate. Suitable alkanolamine salts include the hydrochloride, nitrate, sulfate, phosphate and sulfamate salts of 2-amino-2-methyl-1-propanol, tris (hydroxymethyl) aminomethane and 2-amino-2-ethyl-1-3-propanediol. Suitable metal salts include aluminum chlorohydroxide, aluminum chloride, aluminum nitrate, aluminum sulfate, magnesium chloride, magnesium nitrate, magnesium sulfate, zinc chloride, zinc nitrate and zinc sulfate.

In one embodiment of the invention, the catalyst is a halide or nitrate salt of zinc or magnesium, and preferably the catalyst is magnesium chloride. An organic acid, such as citric acid, may be used in combination with the halide or nitrate salt of zinc or magnesium. Generally the molar ratio of metal salt to organic acid is from about 5:1 to about 20:1. In one embodiment, the catalyst comprises magnesium chloride and citric acid, while in another embodiment the catalyst comprises magnesium chloride and aluminum chloride. Catalysts may be in the form of solutions.

The fabric is typically treated with an amount of catalyst sufficient to catalyze cross-linking of the natural fibers by the formaldehyde to provide a durable press treatment and/or reduced shrinkage, for example reduced shrinkage upon aqueous laundering. In one embodiment, the catalyst may be employed in an amount sufficient to provide a formalin:catalyst solution weight ratio of from about 10:1 to about 1:10, and preferably from about 5:1 to about 1:5. In a specific embodiment, a ratio of about 3.5:1 is employed.

The formaldehyde-containing treatment composition may comprise, by weight, up to about 12%, preferably from about 1% to about 9%, more preferably from about 2 to about 8%, of a catalyst solution. Generally the catalyst solution comprises from about 20% to about 50%, by weight catalyst. In one embodiment, the treatment solution comprises from about 6% to about 8% by weight of a catalyst solution comprising about 30% by weight catalyst. In yet a further embodiment, the catalyst solution comprises about 40%, by weight, magnesium chloride, for a final magnesium chloride level of up to about 5%, by weight of the treatment solution. Suitable catalyst solutions include FREECAT® LF (magnesium chloride and citric acid) and FREECAT® No. 9 (aluminum chloride and magnesium chloride), commercially available from B. F. Goodrich.

The formaldehyde-containing treatment composition typically comprises a liquid carrier, preferably water, although, as noted above, the formalin used to prepare the treatment composition may comprise small amounts of organic solvents such as methanol or the like. In one embodiment, the treatment composition is free of any organic solvents other than that present in the formalin or the catalyst solution. In another embodiment, the carrier may comprise pentamethylcyclosiloxane.

According to the present invention, a silicone elastomer or precursor thereof is included in the formaldehyde-containing treatment composition with which the fabric is treated. Thus, the formaldehyde-containing treatment composition comprises formaldehyde, catalyst and silicone elastomer or a precursor thereof. It has been surprisingly discovered that the combination of a silicone elastomer or precursor thereof and the formaldehyde-containing treatment composition provides the fabric comprising rayon fibers with good durable press and dimensional stability properties while also providing good water absorbency. This is surprising in that many conventional durable press and/or shrinkage resistance treatments render the treated fabrics hydrophobic. The silicone elastomer may also be effective to reduce the loss in tear strength that typically occurs during formaldehyde cross-linking of fibers.

Various silicone elastomers are known in the art and are suitable for use in the methods and fabrics of the invention. In one embodiment, the silicone elastomer is a polysiloxane. Similarly, the silicone elastomer precursor which forms an elastomer upon curing, typically by self curing, may be a polysiloxane. Elastomers are polymers which are capable of being stretched with relatively little applied force, and which return to the unstretched length when the force is released. Silicone elastomers have a backbone made of silicon and oxygen with organic substituents attached to silicon atoms, with a number n of repeating units of the general formula:

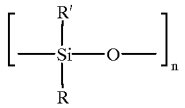

The groups R and R' are each independently selected from lower alkyls, preferably $C_1$–$C_3$ alkyls, phenyl, or lower alkyls or phenyls comprising a group reactive to cellulose, such as hydroxy groups, halogen atoms, for example, fluoride, or amino groups. Suitable elastomers include those disclosed in U.S. Pat. No. 5,885,303, incorporated herein by reference.

A preferred silicone elastomer or precursor composition comprises up to about 60%, by weight, silicone solids. In one embodiment, the silicone elastomer or precursor composition comprises from about 20% to about 60%, preferably from about 30% to about 60%, by weight of silicone solids, while in another embodiment the silicone elastomer or precursor composition comprises from about 20% to about 30% by weight of silicone solids. Suitable silicone elastomer compositions include a dimethyl silicone emulsion containing from about 30% to about 60%, by weight, silicone solids, commercially available as SM2112 from General Electric. Other suitable commercially available elastomer compositions are Sedgesoft ELS from Sedgefield Specialties, containing from about 24% to about 26%, by weight, silicone solids, and Glosil ECR from Glotex Chemical Company.

Silicone elastomer compositions may further comprise one or more emulsifying agents. Suitable emulsifying agents include cationic and nonionic emulsifying agents. While not being bound by theory, it is believed that the emulsifying agents enable the silicone elastomer compositions to spread easily over fibers.

When the silicone elastomer or precursor thereof is applied to the fabric with a liquid formaldehyde-containing treatment composition, the liquid treatment composition may comprise up to about 10%, preferably from about 0.5% to about 5%, more preferably from about 0.5% to about 3%, by weight of the composition comprising elastomer or precursor solids. The elastomer or precursor solids are typically in the form of an emulsion. In one embodiment, the treatment composition comprises from about 0.5% to about 3%, preferably from about 1.5% to 3%, by weight silicone emulsion composition, while in another embodiment, the treatment composition comprises from about 1% to about 1.5% by weight silicone emulsion composition. In one embodiment, the treatment composition comprises from about 0.1% to about 1%, preferably from about 0.5% to 1%, by weight silicone solids, while in another embodiment, the composition comprises from about 0.3% to about 0.5% by weight silicone solids.

The addition of the silicone elastomers or precursors thereof to the treatment solution reduces the loss in tear strength many woven fabrics exhibit when treated with formaldehyde. Generally the silicone elastomers or precursors thereof are present in an amount sufficient to reduce the loss of tear strength in the treated woven fabric, as compared to a woven fabric treated with formaldehyde and catalyst in the absence of silicone elastomer or precursors thereof. When the fabric is a knitted fabric, the burst strength of such fabric remains adequate when treated with silicone elastomers or precursors thereof.

In a preferred embodiment the liquid treatment composition comprises up to about 5%, preferably from about 1% to about 5%, more preferably from about 1% to about 3%, by weight, of an elastomer composition, preferably a silicone elastomer composition. As used herein, "elastomer composition" is intended to refer to a composition comprising precursors which form elastomers upon curing. A preferred elastomer composition comprises precursors which self-cross link to form a silicone elastomer. The elastomer composition may be in the form of a solution or emulsion.

A preferred silicone elastomer precursor composition comprises up to about 60%, by weight, silicone solids. In one embodiment, the silicone elastomer composition comprises from about 20% to about 60%, preferably from about 30% to about 60%, by weight, silicone solids, while in another embodiment the silicone elastomer composition comprises from about 20% to about 30%, preferably from about 24% to about 26%, by weight, silicone solids.

While not being bound by theory, it is believed that the silicone elastomer precursors self-cross-link during curing, thus adhering to fibers. When the treatment composition comprises silicone elastomer precursors, the final treated composition is provided with silicone elastomers.

Some polysiloxanes, generally referred to as silicone oils, have a liquid form and do not self-cross-link. Silicone oils include, for example, non-reactive linear polydimethyl siloxanes, that is, siloxanes which are not capable of further reaction with other silicones. Silicone oils have a tendency to produce non-removable spots, and do not decrease the tear strength loss generally exhibited after formaldehyde cross-linking. In contrast, the silicone elastomers used in the present invention generally do not produce such spots, and the inclusion of silicone elastomer precursors in the liquid treatment compositions decrease the tear strength loss which yarn and textiles comprising natural fibers often experience during formaldehyde cross-linking.

Although the treatment composition may comprise silicone oil, in one embodiment the treatment composition is substantially free of, preferably free of, silicone oil. As used herein, substantially free of silicone oil means the treatment compositions comprises less than about 1%, by weight, silicone oil. In another embodiment the treatment composition may contain silicone oil, however, after drying and curing the treated fabric is substantially free of, preferably free of, silicone oil. As used herein, substantially free of silicone oils means the treated fabric comprises less than about 1%, on weight of fabric, silicone oil.

Thermosetting resins used to impart durable press properties to fabrics are generally aminoplast resins which are the products of the reaction of formaldehyde with compounds such as urea, thiourea, ethylene urea, dihydroxyethylene urea, melamines and glyoxal. As used herein "aminoplast resins" is intended to include N-methylolamide cross-linking agents such as dimethylol dihydroxyethylene urea, dimethylol urea, dimethylolethylene urea, dimethylol propylene urea, dimethylol methyl carbamate, dimethylol n-propylcarbamate, dimethylol isopropylcarbamate trimethylolated melamine, and tris(methoxymethol) melamine. Preferably, the fabrics, methods and formaldehyde-containing treatment compositions of the invention are substantially free of, and more preferably are free of, aminoplast resins and N-methylol cross-linking agents. As used herein, "substantially free" of aminoplast resins and N-methylol cross-linking agents is intended to mean the fabrics and treatment solutions comprise less than about 0.5%, by weight, aminoplast resin or methylol cross-linking agent.

The treatment composition may further comprise additional softeners or additives to alter the handle and aesthetic properties of the fabric. Several of these softeners include but should not be limited to silicone softeners (dimethyl fluids), methylhydrogen fluids, amino-functional, epoxy functional, elastomeric softeners (silicone, urethane, etc.), non-ionic softeners (polyethylene emulsions, ethyloxylated non-ionic compounds), and cationic softeners (amine functional, fatty aminoesters, fatty amidoamides, imidazolines, quaternary ammonium salts other than those used to prepare the dye binding site). In another embodiment the treatment composition is free of additional softeners. In a more particular embodiment, the treatment solution is preferably free of polyethylene emulsions and dimethyl silicone fluids.

The composition may comprise a wetting agent, preferably a nonionic wetting agent. While not being bound by theory, it is believed that the wetting agent facilitates a thorough and effective distribution of the treatment solution throughout the fabric. Generally wetting agents are present at levels sufficient to provide up to about 1%, preferably about 0.1%, on weight of fabric. Suitable wetting agents include alkyl aryl polyether alcohols. In one embodiment the treatment composition comprises about 1.2%, by weight of the composition, wetting agent. The treatment composition may further comprise urea or pH adjusters, such as organic and inorganic acids. If desired, the treatment composition may comprise glycol ethers, such as diethylene glycol dimethyl ether, triethylene glycol dimethyl ether, and tetraethylene glycol dimethyl ether.

The formaldehyde-containing treatment composition may be applied to the fabric in accordance with any of the conventional techniques known in the art. In one embodiment, the treatment composition may be applied to the fabric by saturating the fabric in a trough and squeezing the saturated fabric through pressure rollers to achieve a uniform application (padding process). As used herein "wet pick-up" refers to the amount of treatment composition applied to and/or absorbed into the fabric based on the original weight of the fabric. "Original weight of the fabric" or simply "weight of the fabric" refers to the weight of the fabric prior to its contact with the treatment composition. For example, 50% pick-up means that the fabric picks up an amount of treatment solution equal to 50% of the fabric's original weight. Preferably the wet pick-up is at least about 20%, preferably from about 50% to 100%, more preferably from about 65% to about 80%, by weight of the fabric.

Other application techniques which may be employed include kiss roll application, engraved roll application, printing, foam finishing, vacuum extraction, spray application or any process known in the art. Generally theses techniques provide lower wet pick-up than the padding process. The concentration of the chemicals in the solution may be adjusted to provide the desired amount of chemicals on the original weight of the fabric (OWF).

The fabric may be padded such that the amount of silicone elastomer composition on the fabric prior to heat curing is up to about 4%, preferably up to about 3%, more preferably from about 0.2% to about 3%, and even more preferably from about 1% to about 3%, by weight of fabric. In another embodiment the amount of silicone elastomer composition on the fabric prior to heat curing is up to about 3%, preferably from about 0.1% to about 2%, more preferably from about 1% to about 2%, by weight of fabric.

In one embodiment, prior to heat curing the fabric comprises from about 1% to about 12%, preferably from about 1% to about 8%, by weight of fabric, formaldehyde, or from about 2% to about 30%, preferably from about 2% to about 20%, on weight of fabric, of a formalin solution comprising 37% formaldehyde. The fabric also comprises from about 1.5% to about 6%, preferably from about 2% to about 6%, on weight of fabric, of 30% catalyst solution; and from about 1% to about 3%, on weight of fabric, of an elastomer composition comprising about 20% to about 60%, by weight of composition, elastomer or precursors thereof, for a final elastomer level of from about 0.2% to about 1.8%, by weight of fabric. In a more preferred embodiment, prior to heat curing the fabric comprises from about 1% to about 3% of an elastomer composition comprising about 35%, by weight of the elastomer composition, elastomer or precursors thereof. The fabric may further comprise from about 0% to about 2%, by weight, urea.

Once the treatment composition has been applied to a fabric comprising natural fibers, preferably cellulose fibers, the fabric is typically heated for a time and at a temperature sufficient for the cross-linking of natural fibers, preferably cellulose fibers, with the formaldehyde. For example, the fabric may be heated at a temperature greater than about 250° F., preferably from about 250° F. to about 350° F., and in one embodiment from about 290° F. to about 305° F., in an oven for a period of from about 15 seconds to about 15 minutes, preferably from about 45 seconds to about 3 minutes, to reduce the moisture content on the fabric and to react the formaldehyde with the natural fibers in the fabric and effect cross-linking of the formaldehyde and natural fibers to provide durable press and/or shrinkage resistance effects. There is an inverse relationship between curing temperature and curing time, that is, the higher the temperature of curing, the shorter the dwell time in the oven; conversely, the lower the curing temperature, the longer the dwell time in the oven.

In another embodiment, the present invention comprises methods for improving the water absorbency of fabric, wherein the silicone elastomer may be included in the treated fabric by means of a separate treatment step before or after the formaldehyde cross-linking treatment. Additionally, if the silicone elastomer or precursor thereof is applied to the fabric subsequent to treatment with the formaldehyde cross-linking composition, the silicone elastomer precursor thereof may be applied prior to or subsequent to the heating step which is employed to affect curing of the formaldehyde with the natural fibers of the fabric, although application prior to heating is preferred. The applied silicone elastomer or precursor thereof may be dried, with self curing of the precursor being affected thereby.

Unreacted formaldehyde remaining on the fabric is removed during subsequent processing of the fabric. Generally, the final fabric will comprise less than about 200 ppm formaldehyde, preferably less than about 100 ppm formaldehyde, and more preferably less than about 50 ppm formaldehyde, as measured according to AATCC Test Method 112.

Prior to treatment with the formaldehyde composition and silicone elastomer or precursor thereof, the fabric may optionally be prepared using any fiber, yarn, or textile pre-treatment preparation techniques known in the art. Suitable preparation techniques include brushing, singeing, desizing, scouring, mercerizing, and bleaching. For example, fabric may be treated by brushing which refers to the use of mechanical means for raising surface fibers which will be removed during singeing. The fabric may be then be singed using a flame to burn away fibers and fuzz protruding from the fabric surface. Textiles may be desized, which refers to the removal of sizing chemicals such as starch and/or polyvinyl alcohol, that are put on yarns prior to weaving to protect individual yarns. The fabrics may be scoured, which refers to the process of removing natural impurities such as oils, fats and waxes and synthetic impurities such as mill grease from fabrics. Mercerization refers to the application of high concentrations of sodium hydroxide to a fabric to alter the morphology of fibers, particularly cotton fibers. Fabrics may be mercerized to improve fabric stability and luster. Finally, bleaching refers to the process of destroying any natural color bodies within the natural fiber. A typical bleaching agent is hydrogen peroxide.

The various preparation techniques are optional and dependent upon the desired final product. For example, when the final fabric is to be dyed a dark color, there may be no need to bleach the substrate. Similarly, there may be no need to desize a knit which was prepared without using any sizing agents, and no need to separately scour knits and woven textiles as the scouring may be done during bleaching.

In an additional embodiment, the fabric may be subjected to a liquid ammonia treatment wherein fibers are swelled to provide one or more benefits of deeper dyeing, increased luster, increased brightness and/or improved moisture absorption.

Fabrics in accordance with the present invention may be dry-cleaned or aqueous laundered. The present invention further encompass methods of commercial and/or home laundering and commercial and/or home drying a fabric comprising rayon fibers. The method comprises the steps of aqueous laundering the fabric, and then drying the fabric. The aqueous laundering step comprises laundering the fabric with an aqueous solution at a temperature in the range of from about 60° F. to about 145° F., preferably from about 60° F. to about 95° F. In one embodiment after the fabric has been laundered and dried at least one time the fabric exhibits a change in dimension in length and a width of less than about 5% each, while in another embodiment after the fabric has been laundered and dried at least one time the fabric exhibits a total shrinkage of no greater than about 10%.

The drying step may be selected from line-drying, drying while flat, machine tumble drying, or passing through a drying tunnel. Fabrics or garments passing through a drying tunnel may be treated with steam or may not be treated with steam. Since some consumers prefer the ease of machine tumble drying, in one embodiment the fabric is machine tumbled dried, generally at a "low", "knit" or "permanent press" dryer setting. In another embodiment, the fabric is line dried or dried flat. Fabrics in accordance with the invention show improved durable press properties, that is, a smoother appearance, than conventional rayon containing fabrics, particularly when line dried.

The following examples are set forth to demonstrate the good water absorbency, good dimensional stability and good durable press properties exhibited by fabrics according to the present invention. In a preferred embodiment, fabrics in accordance with the present invention simultaneously demonstrate the good water absorbency, good dimensional stability and good durable press properties while at the same time maintaining acceptable strength and softness.

Throughout the examples and the present specification, parts and percentages are by weight unless otherwise specified. The following examples are illustrative only and are not intended to limit the scope of the methods and fabrics of the invention as defined by the claims.

Throughout the examples, unless indicated otherwise, the following test methods are used:

| | |
|---|---|
| Water Absorbency | AATCC 79-1995 |
| Durable Press | AATCC 124-1996 |
| Shrinkage | AATCC 135-1995 |
| Torque | AATCC 179-1996 (Measurement Method Option 1) |
| Tensile Strength | ASTM D5035-90 |
| Tear strength | ASTM D2261-96 |
| Burst Strength | ASTM D3787-89. |

Generally, in AATCC Method 79-1995 a drop of water is placed on the fabric surface and the time taken for the specular reflection of the drop to disappear is measured as an indication of the water absorbency of the fabric. The shorter the time, the better the water absorbency of the fabric. Generally, in AATCC 124-1996, the appearance of fabric samples are compared with appropriate reference standards, and the larger the number the better the durable press of the fabrics, while in AATCC 135-1995 generally dimensional changes (changes in length and in width) of fabric samples subjected to laundering and drying are measured using pairs of bench marks applied to the fabric before laundering. Test AATCC 179-1996 measures the torque or skewness exhibited by knitted fabrics after washing and drying. Strength measurements are performed using an Instron 4201-5500R instrument; the larger the values, the stronger the fabric.

Softness measurements are performed with a TRI Softness Tester in accordance with the method in the operator's manual. The larger the softness value, the greater the softness. The KES MIU value measurements are performed with a Kawabata Evaluation System KES-SE Friction Tester in accordance with the method in the operator's manual. The smaller the KES MIU value, the smoother the fabric; the larger the KES MIU value, the rougher the fabric.

EXAMPLE 1

Generally, fabrics are treated with formaldehyde by contacting fabric with an aqueous solution comprising of formalin, catalysts, silicone elastomer and, optionally, wetting agent. The aqueous solution is padded onto the fabric to provide a moisture content of greater than about 30%, and the treated fabric is heated at a temperature and a time sufficient to effect the cross-linking of the formaldehyde with the cellulose in the rayon fibers. Some exemplary fabric types and ingredient levels are set forth below in Table 1. Values are given in percent on weight of fabric.

TABLE 1

Level of Treatment Ingredients as % on Weight of Fabric

| Rayon Type | Formalin (37% Formaldehyde) | Catalyst (Freecat #9) | Silicone Elastomer Composition (GE SM2112) | Wetting Agent (Triton X100) |
|---|---|---|---|---|
| 100% Rayon | 18 | 5.0 | 1.5 | 0.1 |
| 100% Lyocell | 15 | 4.2 | 1.5 | 0.1 |
| 50/50 Rayon/Polyester | 8 | 2.3 | 1.5 | 0.1 |
| 50/50 Rayon/Cotton | 8 | 2.3 | 1.5 | 0.1 |
| 50/50 Linen/Rayon | 10 | 2.8 | 1.5 | 0.1 |

EXAMPLE 2

Three fabrics are provided with a formaldehyde cross-linking treatment by contacting the fabrics with a treatment composition comprising formalin (F), catalyst (C) and silicone elastomer (SE) and heat-curing. The fabrics are evaluated to determine their durable press, shrinkage, and water absorbency properties. For comparison purposes, untreated samples of each fabric and samples of each fabric provided with a conventional aminoplast resin (AR) or a conventional aminoplast resin (AR) and silicone softener (SS) combination are also subjected to measurement of their water absorbency, durable press and shrinkage properties. The aminoplast treated fabric samples are prepared by contacting the fabrics with a composition comprising aminoplast resin (AR), and, optionally a polyethylene softener (PE) and/or cationic silicone softener (SS), and heat curing. The treatment chemistry, i.e. the percent by weight of ingredients in the treatment bath, applied to each fabric sample swatches using a padder (Mathis VSM350) is set forth in Tables 2–4. After the treatment chemistry is applied, each sample is placed on a pin frame, and is dried and cured in a dryer (Mathis Lab Dryer Type LTE) for 3 minutes at 300° F.

Viscose, modal and lyocell rayon fabrics and a blend of 50% rayon and 50% polyester are tested for absorbency, durable press and shrinkage. Untreated samples are numbered 4a and 4b, 16a and 16b, and 19a and 19b, in order to indicated that two sets of control samples were evaluated. The treatment chemistry, i.e. the percent by weight of ingredients in the treatment bath, applied to each fabric sample is also set forth in Table 2. In Table 2, a plus (+) value in the shrinkage column indicates an increase or growth in that direction.

TABLE 2

Absorbency, Durable Press and Shrinkage of Rayon Containing Fabrics

| Sample | Rayon Fabric | Treatment Chemistry | Absorbency, no wash cycles (seconds) | Absorbency, 1 wash cycle, 95° F. (seconds) | Durable Press | Shrinkage % length × % width |
|---|---|---|---|---|---|---|
| 1 | Viscose | AR (15%)[1] | <1 | <1 | 2.0 | 3.8 × 1.5 |
| 2 | Viscose | AR (7.5%) | <1 | <1 | 1.1 | 9.4 × 6.0 |
| 3 | Viscose | AR (22%) | <1 | <1 | 1.5 | 2.8 × 1.4 |

TABLE 2-continued

Absorbency, Durable Press and Shrinkage of Rayon Containing Fabrics

| Sample | Rayon Fabric | Treatment Chemistry | Absorbency, no wash cycles (seconds) | Absorbency, 1 wash cycle, 95° F. (seconds) | Durable Press | Shrinkage % length × % width |
|---|---|---|---|---|---|---|
| 4a | Viscose | Untreated | <1 | <1 | 1.0 | 10.8 × 7.5 |
| 4b | Viscose | Untreated | NA | NA | 1.0 | 9.7 × 4.8 |
| 5 | Viscose | AR (15%) + SS (3%)[2] | >270 | >300 | 2.1 | 3.8 × 3.7 |
| 6 | Viscose | AR (15%) + PE (3%)[3] | <1 | <1 | 2.4 | 4.1 × 1.6 |
| 7 | Viscose | AR (15%) + SS (3%) + PE (3%) | 100 | >300 | 1.9 | 3.9 × 3.4 |
| 8 | Viscose | AR (15%) + SS (4.5%) + PE (4.5%) | 93 | >300 | 2.5 | 3.4 × 1.18 |
| 9 | Viscose | AR (15%) + SS (6%) + PE (6%) | 70 | >300 | 1.9 | 3.7 × 1.7 |
| 10 | Viscose | SS (3%) + PE (3%) | >300 | >300 | 2.1 | 5.2 × 0.9 |
| 11 | Viscose | F (27.7%) + SE (3%) | N/A | 13 | 3.1 | 0.9 × 0.2 |
| 12 | Viscose | AR (15%) + SE (3%) | 15 | 20 | 2.7 | 3.4 × 1.8 |
| 13 | Viscose | AR (15%) + SE (3%) + PE (3%) | 62 | 67 | 2.4 | 3.5 × 2.3 |
| 14 | Modal | AR (15%) + SS (3%) + PE (3%) | >300 | >300 | 2.7 | 1.7 × 1.0 |
| 15 | Modal | F (27.7%) + SE (3%) | <1 | 16 | 4.1 | +0.1 × 0.0 |
| 16a | Modal | Untreated | NA | <1 | 1.0 | 5.3 × 0.6 |
| 16b | Modal | Untreated | NA | NA | 1.0 | 7.2 × 1.8 |
| 17 | Lyocell | AR (15%) + SS (3%) + PE (3%) | 88 | >300 | 2.9 | 0.3 × +0.2 |
| 18 | Lyocell | F (27.7%) + SE (3%) | <1 | 6 | 3.1 | 0.2 × 0.1 |
| 19a | Lyocell | Untreated | NA | <1 | 1.0 | 7.1 × 0.6 |
| 19b | Lyocell | Untreated | NA | NA | 1.0 | 4.3 × 1.0 |

[1]AR = B. F. Goodrich Free Res 845 reactant (contains catalyst, self-buffered and low FA)
[2]SS = High Point Chemical cationic silicone softener emulsion, Sil-Fin WHP
[3]PE = Gencorp high density polyethylene emulsion, Mycon HD
NA = not available Samples 11, 15 and 18 are according to the present invention and are treated with both formaldehyde (formalin), a catalyst and silicone elastomer. Although not specified in Table 1, the catalyst is employed in an approximately 3:1 ratio with the formaldehyde. Water absorbency is tested prior to any washing of the fabric and after one wash cycle conducted at about 95° F. As is apparent from Table 2 the rayon fabric samples according to the invention, Samples 11, 15 and 18, exhibit excellent water absorbency, particularly after washing.

It is important to note that neither the resin treated Samples 1–3 and 6 nor the non-resin-treated Samples 4, 16 and 19 exhibit good dimensional stability, i.e., shrink resistance. All of these rayon fabrics exhibit significant and unacceptable shrinkage after one washing. Thus, while Samples 1–4, 6, 16 and 19 exhibit good water absorbency, these fabrics are unacceptable for consumer use owing to their dimensional instability. On the other hand, comparative fabric Samples 5, 7–10, 13–14 and 17 are further unacceptable for consumer use in view of their very poor water absorbency. One skilled in the art will recognize that water absorbency times of greater than about 300 seconds indicate that the fabrics exhibit poor water absorbency. It is believed that the combination of softeners with the aminoplast resin, particularly silicone softeners which are conventionally used to improve the feel of aminoplast resin-treated fabrics, contribute to the poor water absorbency of the fabrics.

Importantly, fabrics according to the present invention, Samples 11, 15 and 18, exhibit durable press values of at least 3 in combination with good shrinkage control and water absorbency. In contrast, samples 1–7, 9–10, 13, 16 and 19 all exhibit durable press values of less than 2.5. Samples 8 and 14 exhibit durable press values of 2.5 and 2.7, respectively, unfortunately, these samples also exhibit poor water absorbency. Sample 12 exhibits a durable press value of 2.7, but exhibits an unacceptable level of dimensional instability. Thus, fabrics treated with formalin and silicone elastomer exhibit a combination of durable press, shrinkage, and absorbency values which are superior to the combination of durable press, shrinkage, and absorbency values exhibited by fabrics treated with aminoplast resins.

Thus, the advantages of the rayon fabric samples 11, 15 and 18 according to the present invention which exhibit good water absorbency in combination with good dimensional stability, particularly shrink resistance, and good durable press properties are evident.

Samples 1–19 are further evaluated for KES MIU values and softness values, while Samples 1–17 and 19 are evaluated for filling direction tensile strengths and filling direction tear strengths. Some fabrics, such as samples 12, 13 and 17 are evaluated twice. The results are set forth below in Table 3.

TABLE 3

KES MIU Values and Softness of Rayon Containing Fabrics

| Sample | Rayon Fabric | Treatment Chemistry | KES MIU Value | Softness Value | Filling Tensile Strength (pounds) | Filling Tear Strength (pounds) |
|---|---|---|---|---|---|---|
| 1 | Viscose | AR (15%)[1] | 0.93 | 13.1 | 43.0 | 1.9 |
| 2 | Viscose | AR (7.5%) | 0.98 | 13.8 | 65.6 | 1.7 |
| 3 | Viscose | AR (22%) | NA | 12.7 | 34.6 | 1.4 |
| 4a | Viscose | Untreated | 1.01 | 13.9 | 42.6 | 1.5 |
| 4b | Viscose | Untreated | NA | NA | 45.2 | 1.6 |
| 5 | Viscose | AR (15%) + SS (3%)[2] | 0.71 | 16.2 | 48.3 | 3.9 |
| 6 | Viscose | AR (15%) + PE (3%)[3] | 0.96 | 13.1 | 63.4 | 2.2 |
| 7 | Viscose | AR (15%) + SS (3%) + PE (3%) | 0.88 | 14.3 | 54.0 | 3.6 |
| 8 | Viscose | AR (15%) + SS (4.5%) + PE (4.5%) | 0.88 | 14.2 | 49.3 | 3.8 |
| 9 | Viscose | AR (15%) + SS (6%) + PE (6%) | 0.89 | 14.3 | 38.4 | 3.5 |
| 10 | Viscose | SS (3%) + PE (3%) | 0.99 | 15.1 | 47.4 | 4.9 |

TABLE 3-continued

KES MIU Values and Softness of Rayon Containing Fabrics

| Sample | Rayon Fabric | Treatment Chemistry | KES MIU Value | Softness Value | Filling Tensile Strength (pounds) | Filling Tear Strength (pounds) |
|---|---|---|---|---|---|---|
| 11 | Viscose | F (27.7%) + SE (3%) | 1.07 | 14.8 | 54.5 | 2.4 |
| 12 | Viscose | AR (15%) + SE (3%) | 0.95 | 13.4 and 11.0 | 50.3 | 2.3 |
| 13 | Viscose | AR (15%) + SE (3%) + PE (3%) | 0.95 | 12.8 and 11.8 | 44.2 | 2.9 |
| 14 | Modal | AR (15%) + SS (3%) + PE (3%) | 0.66 | 11.9 | 42.0 | 3.2 |
| 15 | Modal | F (27.7%) + SE (3%) | 0.84 | 10.4 | 54.4 | 2.0 |
| 16a | Modal | Untreated | NA | 14.3 | 59.6 | 2.6 |
| 16b | Modal | Untreated | NA | 7.2 | 46.4 | 2.1 |
| 17 | Lyocell | AR (15%) + SS (3%) + PE (3%) | 0.78 | 8.8 and 9.2 | 41.7 | 5.9 |
| 18 | Lyocell | F (27.7%) + SE (3%) | 1.26 | 8.3 | NA | NA |

TABLE 3-continued

KES MIU Values and Softness of Rayon Containing Fabrics

| Sample | Rayon Fabric | Treatment Chemistry | KES MIU Value | Softness Value | Filling Tensile Strength (pounds) | Filling Tear Strength (pounds) |
|---|---|---|---|---|---|---|
| 19a | Lyocell | Untreated | NA | 5.5 | 100.0 | 3.7 |
| 19b | Lyocell | Untreated | NA | NA | 93.4 | 4.2 |

[1]AR = B. F. Goodrich Free Res 845 reactant (contains catalyst, self-buffered and low FA)
[2]SS = High Point Chemical cationic silicone softener emulsion, Sil-Fin WHP
[3]PE = Gencorp high density polyethylene emulsion, Mycon HD
NA = not available Samples 11, 15 and 18, fabrics according to the present invention, exhibit acceptable KES MIU values and softness values in combination with the good shrinkage, durable press and water absorbency properties as indicated in Tables 2 and 3. Samples 11 and 15, fabrics according to the present invention, also exhibit good strength values of at least about 50 pounds for filling tensile strength and at least about 2 pounds for filling tear strength. By comparison, the normal industry standards for cotton shirting fabric is a filling tensile strength of 26 pounds and a filling tear strength of 24 ounces (1.5 pounds).

Fabric samples are evaluated to determine the maintenance of good durable press properties after multiple launderings. The fabric samples are washed in 95° F. water and either tumble or line dried. Shrinkage is determined after one and five washes, while durable press values are determined after one and five washes for machine-dried fabric samples and after two washes for line-dried fabric samples. Results are set forth in Table 4 below.

TABLE 4

Durable Press and Shrinkage After Multiple Washes

| Sample | Rayon Fabric | Treatment Chemistry | Shrinkage, 1 wash, % length × % width | Shrinkage, 5 washes, % length × % width | DP 1 wash Machine Dry | DP 5 washes Machine Dry | DP 2 washes Line dry |
|---|---|---|---|---|---|---|---|
| 1 | Viscose | AR (15%)[1] | 3.8 × 1.5 | 5.0 × 1.7 | 2.0 | 1.2 | 1.0 |
| 2 | Viscose | AR (7.5%) | 9.4 × 6.0 | 8.7 × 3.7 | 1.1 | 1.2 | 1.2 |
| 3 | Viscose | AR (22%) | 2.8 × 1.4 | 3.6 × 1.7 | 1.5 | 1.4 | 1.0 |
| 4a | Viscose | Untreated | 10.8 × 7.5 | 12.7 × 6.6 | 1.0 | 1.3 | 1.4 |
| 4b | Viscose | Untreated | 9.7 × 4.8 | NA | 1.0 | NA | NA |
| 5 | Viscose | AR (15%) + SS (3%)[2] | 3.8 × 3.7 | 4.1 × 3.2 | 2.1 | 1.9 | 1.4 |
| 6 | Viscose | AR (15%) + PE (3%)[3] | 4.1 × 1.6 | 4.7 × 1.4 | 2.4 | 1.4 | 1.2 |
| 7 | Viscose | AR (15%) + SS (3%) + PE (3%) | 3.9 × 3.4 | 4.7 × 2.5 | 1.9 | 1.4 | 1.2 |
| 8 | Viscose | AR (15%) + SS (4.5%) + PE (4.5%) | 3.4 × 1.8 | 4.1 × 1.6 | 2.5 | 1.3 | 1.1 |
| 9 | Viscose | AR (15%) + SS (6%) + PE (6%) | 3.7 × 1.7 | 4.4 × 1.5 | 1.9 | 1.3 | 1.1 |
| 10 | Viscose | SS (3%) + PE (3%) | 5.2 × 0.9 | 7.5 × 2.1 | 2.1 | 1.2 | 1.7 |
| 11 | Viscose | F (27.7%) + SE (3%) | 0.9 × 0.2 | 1.0 × 0.3 | 3.1 | 3.5 | 1.2 |
| 12 | Viscose | AR (15%) + SE (3%) | 3.4 × 1.8 | 4.6 × 2.4 | 2.7 | 1.5 | 1.1 |

TABLE 4-continued

Durable Press and Shrinkage After Multiple Washes

| Sample | Rayon Fabric | Treatment Chemistry | Shrinkage, 1 wash, % length × % width | Shrinkage, 5 washes, % length × % width | DP 1 wash Machine Dry | DP 5 washes Machine Dry | DP 2 washes Line dry |
|---|---|---|---|---|---|---|---|
| 13 | Viscose | AR (15%) + SE (3%) + PE (3%) | 3.5 × 2.3 | 4.7 × 2.5 | 2.4 | 1.6 | 1.2 |
| 14 | Modal | AR (15%) + SS (3%) + PE (3%) | 1.7 × 1.0 | 2.3 × 1.3 | 2.7 | 2.1 | 1.1 |
| 15 | Modal | F (27.7%) + SE (3%) | +0.1 × 0.0 | +0.1 × 0.2 | 4.1 | 4.8 | 1.7 |
| 16a | Modal | Untreated | 5.3 × 0.6 | 7.2 × 2.5 | 1.0 | 1.0 | 1.2 |
| 16b | Modal | Untreated | 7.2 × 1.8 | NA | 1.0 | NA | NA |
| 17 | Lyocell | AR (15%) + SS (3%) + PE (3%) | 0.3 × +0.2 | 0.8 × 0.0 | 2.9 | 3.2 | 1.2 |
| 18 | Lyocell | F (27.7%) + SE (3%) | 0.2 × 0.1 | 0.3 × 0.0 | 3.1 | 3.3 | 2.3 |
| 19a | Lyocell | Untreated | 7.1 × 0.6 | 10.8 × 2.2 | 1.0 | 1.0 | 1.2 |
| 19b | Lyocell | Untreated | 4.3 × 1.0 | NA | 1.0 | NA | NA |

[1]AR = B. F. Goodrich Free Res 845 reactant (contains catalyst, self-buffered and low FA)
[2]SS = High Point Chemical cationic silicone softener emulsion, Sil-Fin WHP
[3]SE = Gencorp high density polyethylene emulsion, Mycon HD
Shrinkage is in % length × % width
DP = Durable Press
NA = not available As indicated by Samples 1, 6, 10 and 13–14, fabrics treated with aminoplast resins may lose their durable press properties after repeated launderings. It is believed that the aminoplast resin is lost by repeated laundering and thus the durable press property also decreases. In contrast, Samples 11, 15 and 18, fabrics in accordance with the invention, show good durable press properties even after five cycles of washing and machine drying. Not only do Samples 11, 15 and 18 exhibit good durable press after five cycles of machine washing and machine drying, the samples also exhibit good dimensional stability. In contrast, untreated and resin-treated fabric show significant shrinkage after five washings.

Additionally, vicose, modal, and lyocell rayon samples in accordance with the invention exhibit durable press value after two cycles of washing and line-drying greater than that exhibited by untreated fabrics subjected to the same washing and drying treatment. More particularly, Sample 15, modal rayon in accordance with the invention, exhibits a durable press after two washing and line-drying cycles 1.7, while the untreated modal, Sample 16, exhibits the durable press of only 1.2. Similarly, lyocell rayon in accordance with the invention, Sample 18, shows a durable press after two cycles of washing and line-drying of 2.3, while untreated lyocell rayon, Sample 19, exhibits a durable press value of 1.2. Vicose rayon in accordance with the invention, Sample 11, shows a durable press after two cycles of machine washing and line drying of 1.2. While untreated vicose rayon, Sample 4, shows a durable press after two cycles of washing and line drying of 1.4, the untreated vicose shows excessive shrinkage, and thus would be unacceptable to consumers.

EXAMPLE 3

Fabrics comprising rayon are evaluated for durable press and total shrinkage. The treatment chemistry, i.e. the percent by weight of ingredients in the treatment bath, applied to each fabric sample prior to curing is set forth in Table 5. Briefly, fabrics are treated with formaldehyde by contacting the fabrics with a bath comprising, on weight, 1.2% wetting agent (Trycol 5953), 35% formalin (F), 10% catalyst (C) (Catalyst LF), and 5% silicone elastomer (SE) (Glosil ECR from Glotex Chemical company); and heat curing with an oven temperature of 350° F. and a fabric speed of 28 yards/minute. Fabrics are treated with resin by contacting the fabrics with a bath comprising, on weight, 1.2% wetting agent (Trycol 5953), 6% DMDHEU (AR), 1.5% catalyst, 8% cationic softener (CS) (Fabritone HC), and 2% silicone elastomer (Glosil ECR); and heat curing with an oven temperature of 350° F. and a fabric speed of 28 yards/minute.

The fabrics comprising rayon are washed in either 60° F. water ("cold" machine setting) or 95° F. water ("warm" machine setting), machine dried, and evaluated for total dimensional change, durable press and water absorbency. Both the wash water comprising detergent and the rinse water are at the same temperature. The results are set forth below in Table 5.

In this and the following examples, and throughout the present specification and claims, total area shrinkage is defined as:

$$\frac{(L_{BW} \times W_{BW}) - (L_{AW} \times W_{AW})}{(L_{BW} \times W_{BW})} \times 100$$

wherein L is length, W is width, BW is before washing and AW is after washing.

TABLE 5

Durable Press and Total Shrinkage of Rayon Containing Fabrics

| Sample | Rayon Fabric | Treatment Chemistry | Wash Temperature (° F.) | Total % Shrinkage (% length × % width) | Durable Press |
|---|---|---|---|---|---|
| 1 | Vicose | F (35%) + SE (5%) + C (10%) | 95 | 1.1 (0.9 × 0.2) | 3.1 |
| 2 | Modal | F (35%) + SE (5%) + C (10%) | 95 | 0.1 (0.1 × 0.0) | 4.1 |
| 3 | 100% Rayon | F (35%) + SE (5%) + C (10%) | 60 | 1 (0.2 × 0.7) | 3.7 |
| 4 | 100% Rayon | F (35%) + SE (5%) + C (10%) | 95 | 1 (1 × 0) | 4.5 |
| 5 | 85/15 Rayon/Flax | F (35%) + SE (5%) + C (10%) | 60 | 1 (0 × 1) | 3.8 |
| 6 | 85/15 Rayon/Flax | F (35%) + SE (5%) + C (10%) | 95 | 1 (0 × 1) | 4.4 |
| 7 | 35/50/15 Rayon/Flax/ Lyocell | F (35%) + SE (5%) + C (10%) | 60 | 3.7 (1.7 × 2.0) | 3.6 |
| 8 | 85/15 Rayon/Flax | F (35%) + SE (5%) + C (10%) | 60 | 5.9 (2.9 × 3.1) | 3.2 |
| 9 | 50/50 Rayon/Acetate | F (35%) + SE (5%) + C (10%) | 60 | 9.6 (4.7 × 5.1) | 2.7 |
| 10 | 50/50 Rayon/ Polyester | F (35%) + SE (5%) + C (10%) | 95 | 0.3 (0.1 × 0.2) | 5 |
| 11 | Vicose | AR (6%) + C (1.5%) + CS (8%) + SE (2%) | 95 | 7.3 (3.9 × 3.4) | 1.9 |
| 12 | Modal | AR (6%) + C (1.5%) + CS (8%) + SE (2%) | 95 | 2.7 (1.7 × 1.0) | 2.7 |
| 13 | 100% Rayon | AR (6%) + C (1.5%) + CS (8%) + SE (2%) | 60 | 10 (6.4 × 4.2) | 2.7 |
| 14 | 100% Rayon | AR (6%) + C (1.5%) + CS (8%) + SE (2%) | 95 | 13 (5.0 × 8.0) | 2.6 |
| 15 | 85/15 Rayon/Flax | AR (6%) + C (1.5%) + CS (8%) + SE (2%) | 60 | 6 (1.8 × 4.2) | 2.6 |
| 16 | 85/15 Rayon/Flax | AR (6%) + C (1.5%) + CS (8%) + SE (2%) | 95 | 6 (4.0 × 2.0) | 3 |
| 17 | 35/50/15 Rayon/Flax/ Lyocell | AR (6%) + C (1.5%) + CS (8%) + SE (2%) | 60 | 10 (4.5 × 5.7) | 2.3 |
| 18 | 85/15 Rayon/Linen | AR (6%) + C (1.5%) + CS (8%) + SE (2%) | 60 | 11.4 (7.0 × 4.7) | 2.6 |
| 19 | 50/50 Rayon/Acetate | AR (6%) + C (1.5%) + CS (8%) + SE (2%) | 60 | 49.3 (15.2 × 40.2) | 1 |
| 20 | 85/15 Rayon/Flax | Untreated | 60 | (2.7 × 13.7) | 3.3 |
| 21 | 100% Rayon | Untreated | 60 | (10.5 × 13.6) | 1.3 |
| 22 | 100% Rayon | Untreated | 95 | (12.0 × 10.0) | 2.7 |

TABLE 5-continued

Durable Press and Total Shrinkage of Rayon Containing Fabrics

| Sample | Rayon Fabric | Treatment Chemistry | Wash Temperature (° F.) | Total % Shrinkage (% length × % width) | Durable Press |
|---|---|---|---|---|---|
| 23 | 85/15 Rayon/Flax | Untreated | 95 | (17.0 × 5.0) | 1.3 |

As indicated in Table 5, for each fabric type, the fabric samples treated with a combination of formalin, catalyst and silicone elastomer exhibit total dimensional change and durable press properties superior to those exhibited by fabric samples comprising the same fiber content treated with conventional aminoplast resin. The improved dimensional stability is particularly evidence in the 50/50 rayon/acetate blend. The conventional rayon/acetate blend, Sample 19, exhibits a total shrinkage of over 49%, while the rayon/acetate blend in accordance with the invention, Sample 9, exhibits a total shrinkage of less than 10%.

EXAMPLE 4

As discussed above, knitted fabrics and knitted garments, such as sweaters, are often designed to be textured, or to drape over an individual's body. Thus, consumers who may desire good durable press properties in woven fabrics may be less concerned about the durable press properties of knitted fabrics. However, consumers desire good dimensional stability in both woven and knitted fabrics.

Treated knitted fabric samples are padded with formalin (F), silicone elastomer (SE) and catalyst (C) to provide, on weight of fabric, the levels indicated in Table 6, set forth below. The fabric samples comprise 100% rayon (R) or a 93/5/2 rayon/nylon/spandex blend (R/N/S). The treatment chemistry, i.e. the percent by weight of ingredients in the treatment bath, is applied using a padder manufactured by Butterworth Manufacturing Co., Serial No. M12236. The fabrics are cured at about 300° F. for about 10 minutes in a dryer manufactured by Grieve Corp., Serial No. 19179. As indicated in Table 6, knitted fabrics in accordance with the invention show improved shrinkage when compared to untreated fabrics having the same fiber composition. The knitted fabrics in accordance with the invention still exhibit adequate torque values (skewness values) and burst strengths.

TABLE 6

Dimensional Stability of Knitted Fabrics Comprising Rayon

| Sample | Rayon Fabric | Treatment Chemistry | Shrinkage, % length × % width after 1 wash | Torque % | Burst Strength (pounds) |
|---|---|---|---|---|---|
| 1 | R | F (12%) + SE (1.5%) + C (3.4%) | 3.2 × 8.4 | −2.5 | 109.6 |
| 2 | R | F (15%) + SE (1.5%) + C (4.2%) | 0.3 × 6.2 | −1.9 | 101.0 |
| 3 | R | F (18%) + SE (1.5%) + C (5.0%) | 2.5 × 4.0 | −0.9 | 86.4 |
| 4 | R | Untreated | 1.2 × 26.5 | 10.2 | 110.4 |

TABLE 6-continued

| Dimensional Stability of Knitted Fabrics Comprising Rayon | | | | | |
|---|---|---|---|---|---|
| Sample | Rayon Fabric | Treatment Chemistry | Shrinkage, % length × % width after 1 wash | Torque % | Burst Strength (pounds) |
| 5 | R/N/S | F (12%) + SE (1.5%) + C (3.4%) | 5.5 × 6.3 | 4.8 | 99.2 |
| 6 | R/N/S | F (15%) + SE (1.5%) + C (4.2%) | 5.5 × 4.7 | 1.4 | 93.4 |
| 7 | R/N/S | F (18%) + SE (1.5%) + C (5.0%) | 3.8 × 3.6 | 3.2 | 90.8 |
| 8 | R/N/S | Untreated | 14.0 × 20.2 | 2.7 | 111.6 |

EXAMPLE 5

Knitted jersey fabric comprising about 93.5% rayon and about 6.5% spandex are tested for water absorbency, durable press and torque (skewness). The level of formalin and silicone elastomer, as percent on weight of fabric, for each fabric sample is set forth in Table 7. After the samples are chemically treated and heat cured, the samples are laundered using a liquid laundry detergent (TIDE®) in water at a temperature of 95° F. in the presence or absence of fabric conditioner (DOWNY®), and machine tumble dried.

As indicated by Table 7, knitted jersey fabrics comprising rayon in accordance with the present invention maintain good water absorbency even when washed in the presence of fabric conditioner. Importantly, while the water absorbency of fabrics treated with formalin, silicone elastomer and catalyst are as good as untreated fabrics even when washed with softeners, the treated fabrics also exhibit good shrinkage control.

More particularly, Samples 1 and 5, untreated rayon/spandex knitted fabric exhibit, after one washing and machine-drying, a shrinkage in length and in width each of greater than 6%, while Samples 2–4 and 6–8, samples in accordance with the present invention, exhibit shrinkages of less than 6% in both length and width after one wash.

TABLE 7

| Shrinkage and Absorbency of Rayon/Spandex Knitted Fabric | | | | | | |
|---|---|---|---|---|---|---|
| Sample | Treatment Chemistry | Conditioner in Rinser | Shrinkage, % length × % width after 1 wash | Water Absorbency (seconds) after 1 wash | Durable Press after 1 wash | Torque % |
| 1 | Untreated | Absent | 8.6 × 6.9 | NA | 2.7 | NA |
| 2 | F (22%) + SE (1.5%) + C | Absent | 3.5 × 3.7 | NA | 3.5 | NA |
| 3 | F (22%) + SE (1.5%) + C | Absent | 4.1 × 4.6 | NA | 3.3 | NA |
| 4 | F (22%) + SE (1.5%) + C | Absent | 3 × 4.1 | NA | 3.4 | NA |
| 5 | Untreated | Present | 8.2 × 11 | <1 | 2.7 | 0 |
| 6 | F (22%) + SE (1.5%) + C | Present | 3 × 3.3 | <1 | 3 | −0.4 |
| 7 | F (22%) + SE (1.5%) + C | Present | 5.2 × +4.9 | <1 | 2.6 | 0.5 |
| 8 | F (22%) + SE (1.5%) + C | Present | 2.9 × 3.9 | <1 | 2.9 | −1.9 |

NA = not available

EXAMPLE 6

Three different fabrics are tested for durable press (DP), total % shrinkage (and % length×% width shrinkage) and tensile strength (in pounds) after varying numbers of launderings. The three fabrics comprise a 35/15/50 Rayon/Lyocell/Linen blend (R/L/L), an 85/15 Rayon/Linen blend (R/L), and a 50/50 Rayon/Acetate blend (R/A). The treatment chemistry, i.e. the percent by weight of ingredients in the treatment bath, applied to each fabric sample prior to curing is set forth in Table 8. The samples are laundered with a 12 minute wash cycle using a liquid laundry detergent (TIDE®) in water at a temperature of 60° F. The samples are then machine dried at a "low" setting for 40 minutes, or until the entire load was dry.

TABLE 8

| Durable Press, Shrinkage and Tensile Strength | | | | | | | | | | | | | |
|---|---|---|---|---|---|---|---|---|---|---|---|---|---|
| Sample (Fabric) | Treatment Chemistry | DP, 1 wash | DP, 5 wash | DP, 10 wash | DP, 25 wash | Total Shrinkage, 1 wash | Total Shrinkage, 5 wash | Total Shrinkage 10 wash | Total Shrinkage 25 wash | Tensile, pre-wash | Tensile, 1 wash | Tensile, 10 wash | Tensile, 25 wash |
| 1 (R/L/L) | F (35%) + SE (5%) + C (10%) | 3.6 | 3.8 | 3.9 | 3.6 | 3.7 (1.7 × 2.0) | 5.0 (2.9 × 2.2) | 3.5 (1.7 × 1.9) | 3.9 (2.1 × 1.8) | 37.7 | 43.7 | 42.5 | 36.5 |
| 2 (R/L/L) | AR (6%) + C (1.5%) + CS (8%) + SS (2%) | 2.3 | 2.3 | 2.3 | 2.6 | 10.0 (4.5 × 5.7) | 12.9 (6.2 × 7.2) | 12.3 (5.9 × 6.8) | 14.2 (7.2 × 7.5) | 42.6 | 47.7 | 49.0 | 46.5 |
| 3 (R/L/L) | Untreated | 1.9 | 2.3 | 1.7 | 2.4 | 16.8 (7.2 × 10.3) | 23.6 (11.5 × 13.7) | 25.0 (12.8 × 14.0) | 27.8 (15.1 × 14.9) | 58.7 | 57.4 | 59.8 | 55.4 |
| 4 (R/L) | F (35%) + SE (5%) + C (10%) | 3.2 | 3.7 | 3.8 | 3.5 | 5.9 (2.9 × 3.1) | 6.5 (3.5 × 3.2) | 4.9 (2.8 × 2.2) | 5.5 (3.1 × 2.5) | 60.8 | 60.8 | 58.6 | 55.0 |
| 5 (R/L) | AR (6%) + C (1.5%) + CS (8%) + SS (2%) | 1.9 | 2.6 | 1.9 | 2.7 | 11.4 (7.0 × 4.7) | 14.4 (9.3 × 5.6) | 14.4 (9.7 × 5.3) | 17.4 (12.5 × 5.6) | 51.6 | 54.0 | 56.2 | 58.5 |
| 6 (R/L) | Untreated | 1.6 | 2.2 | 1.8 | 2.5 | 10.7 (9.5 × 1.3) | 18.7 (15.1 × 4.2) | 20.6 (16.3 × 5.1) | 25.0 (19.4 × 7.0) | 59.9 | 73.8 | 65.8 | 60.8 |
| 7 | F (35%) + SE | 2.7 | 3.8 | 3.8 | 3.6 | 9.6 | 10.8 | 11.7 | 12.0 | 21.7 | 22.1 | 22.7 | 21.8 |

TABLE 8-continued

Durable Press, Shrinkage and Tensile Strength

| Sample (Fabric) | Treatment Chemistry | DP, 1 wash | DP, 5 wash | DP, 10 wash | DP, 25 wash | Total Shrinkage, 1 wash | Total Shrinkage, 5 wash | Total Shrinkage 10 wash | Total Shrinkage 25 wash | Tensile, pre-wash | Tensile, 1 wash | Tensile, 10 wash | Tensile, 25 wash |
|---|---|---|---|---|---|---|---|---|---|---|---|---|---|
| (R/A) | (5%) + C (10%) | | | | | (4.7 × 5.1) | (5.7 × 5.4) | (6.1 × 5.9) | (5.9 × 6.5) | | | | |
| 8 (R/A) | AR (6%) + C (1.5%) + CS (8%) + SS (2%) | 1.0 | 1.0 | 1.0 | 1.0 | 49.3 (15.2 × 40.2) | 53.5 (19.2 × 42.5) | 56.7 (20.3 × 45.7) | 57.1 (21.6 × 45.4) | 29.0 | 29.9 | 30.6 | 28.7 |
| 9 (R/A) | Untreated | 1.0 | 1.0 | 1.0 | 1.0 | 51.7 (18.2 × 40.9) | 55.7 (22.5 × 42.9) | 57.5 (23.3 × 44.6) | 58.9 (25.2 × 45.1) | 29.2 | 31.2 | 27.4 | 28.1 |

One of ordinary skill would appreciate that Samples 1, 4 and 7 are fabrics in accordance with the present invention.

TABLE 9

Durable Press, Shrinkage and Water Absorbency

| Sample (Fabric) | Treatment Chemistry | DP, 1 wash | DP, 5 wash | DP, 25 wash | Total Shrinkage, 1 wash | Total Shrinkage, 5 wash | Total Shrinkage, 25 wash | Water Absorbency, sec, 1 wash | Water Absorbency, sec, 5 wash |
|---|---|---|---|---|---|---|---|---|---|
| 1 (R) | F (35%) + SE (5%) + C (10%) | 3.7 | 3.7 | 3.7 | 1 × 0 | 1 × 1 | 1 × 1 | 65.5 | 27.9 |
| 2 (R) | AR (6%) + C (1.5%) + CS (8%) + SE (2%) | 2.7 | 2.4 | 2.7 | 4 × 6 | 5 × 7 | 7 × 8 | >360 | 360 |
| 3 (R) | Untreated | 1.3 | 1.6 | 2.5 | 13 × 1 | 16 × 11 | 21 × 18 | <1 | <1 |
| 4 (L) | F (35%) + SE (5%) + C (10%) | 3.7 | 3.7 | 2.4 | 0 × 4 | 0 × 4 | 9 × 0 | 11.6 | 3.6 |
| 5 (L) | AR (6%) + C (1.5%) + CS (8%) + SE (2%) | 3.4 | 3.1 | 3.4 | 3 × 0 | 4 × 1 | 3 × 2 | >360 | >326 |
| 6 (L) | Untreated | 3.5 | 2.7 | 3.4 | 8 × 1 | 8 × 1 | 11 × 1 | <1 | <1 |
| 7 (R/F) | F (35%) + SE (5%) + C (10%) | 3.8 | 4.1 | 3.8 | 1 × 0 | 1 × 0 | 1 × 0 | 70.4 | 23.6 |
| 8 (R/F) | AR (6%) + C (1.5%) + CS (8%) + SE (2%) | 2.6 | 2.4 | 2.0 | 4 × 2 | 5 × 3 | 4 × 3 | >360 | >360 |
| 9 (R/F) | Untreated | 3.3 | 1.3 | 2.3 | 14 × 3 | 18 × 5 | 14 × 5 | <1 | <1 |

As indicated by the data set forth in Table 8, Samples 1, 4 and 7, show good durable press properties even after 25 washes and acceptable levels of total shrinkage, even after 25 washes. Further, the excellent maintenance of durable press and shrinkage properties throughout 25 washes exhibited by Samples 1, 4, and 7, occurs without appreciable loss of fabric strength. As indicated by the data set forth in Table 8, even after 25 washes, the fabrics demonstrate tensile strength in the filling direction of at least 20 pounds.

EXAMPLE 7

Three different fabrics are tested for durable press (DP), shrinkage (% length×% width) and water absorbency after varying numbers of launderings. The three fabrics comprise 100% Rayon (R), % Lyocell (L), and an 85/15 Rayon/Flax blend (R/F). The samples are prepared according to the method discussed in Example 3. The treatment chemistry, i.e. the percent by weight of ingredients in the treatment bath, applied to each fabric sample prior to curing is set forth in Table 9. The samples are laundered with a 12 minute wash cycle using a liquid laundry detergent (TIDE®) in water at a temperature of 60° F. The samples are then machine dried at a "low" setting for 40 minutes, or until the entire load was dry.

As will be apparent to one of ordinary skill, Samples 1, 4 and 7 are samples in accordance with the invention. The data set forth in Table 9 indicate that Samples 1, 4 and 7 exhibit, after five aqueous washings, durable press values of greater than about 3, shrinkage in length and in width of no greater than about 7% percent each, and water absorbency values of less than 30 seconds. In contrast, although Samples 2, 5 and 8 exhibit acceptable durable press and shrinkage properties after five washes, these samples exhibit water absorbency of greater than 300 seconds. Although Samples 3, 6, and 9 exhibit water absorbencies of less than 30 seconds after five washes, they exhibit durable press and shrinkage properties which would be unacceptable by consumers. Thus, unlike conventional rayon fabrics, Samples 1, 4 and 7, fabrics in accordance with the invention, exhibit a combination of good durable press properties, good shrinkage properties and good water absorbencies even after multiple washings.

EXAMPLE 8

Blends of rayon with other natural fibers, particularly cotton and wool, are tested for durable press, shrinkage and tensile strength. A 50/50 blend of rayon and cotton (R/C) and a 65/35 blend of rayon and wool (R/W) are employed. The treatment chemistry, i.e. the percent by weight of ingredients in the treatment bath, applied to each fabric sample prior to curing is set forth in Table 10. The catalyst composition is present in the treatment bath at a weight ratio of 18:5 formalin:catalyst composition

TABLE 10

Durable Press, Shrinkage and Tensile Strength of Blends Comprising Rayon and Other Natural Fibers

| Sample | Rayon Fabric | Treatment Chemistry | DP 1 wash | Shrinkage % length × % width after 1 wash | Tensile Strength in Filling Direction (pounds) |
|---|---|---|---|---|---|
| 1 | R/C | F (10%) + SE (2%) + C | 3.4 | 3.1 × 3.1 | 38.74 |
| 2 | R/C | F (14%) + SE (2%) + C | 3.6 | 0.9 × 0.2 | 32.94 |
| 3 | R/C | F (18%) + SE (2%) + C | 3.7 | 0.04 × 0.1 | 32.59 |
| 4 | R/C | Untreated | 1.5 | 3.6 × 1.6 | 56.23 |
| 5 | R/W | F (10%) + SE (2%) + C | 2.2 | 5.1 × 1.8 | 46.07 |
| 6 | R/W | F (14%) + SE (2%) + C | 2.4 | 3.2 × 1.0 | 32.25 |
| 7 | R/W | F (18%) + SE (2%) + C | 2.7 | 2.2 × 1.1 | 30.43 |
| 8 | R/W | Untreated | 1.1 | 16.8 × 1.4 | 32.52 |

As indicated by the data set forth in Table 10, blends of rayon and other natural fibers, more particularly cotton and wool, when treated in accordance with the invention show an improvement in durable press after one wash as compared to untreated blends comprising the same fiber composition. The fabrics also show an improvement in shrinkage as compared to untreated blends comprising the same fiber composition; this is particularly evident with respect to the sample comprising 65% rayon and 35% wool.

EXAMPLE 9

Fabrics are evaluated for durable press properties under machine tumble drying and line drying conditions. An 85/15 blend of rayon and flax (R/F), 100% rayon (R) and 100% Lyocell (L) are employed. The samples are prepare according to the method discussed in Example 3. The treatment chemistry, i.e., the percent by weight of ingredients in the treatment bath, applied to each fabric sample prior to curing is set forth in Table 11. The samples are laundered 1, 2, 3 or 5 times using a 12 minute wash cycle using a liquid laundry detergent (TIDE®) in water at a temperature of 60° F. The samples are then either machine dried at a "low" setting for 40 minutes, or until the entire load is dry, or are line dried at room temperature.

TABLE 11

Durable Press After Machine Drying and Line Drying of Rayon Containing Fabrics

| Sample | Fabric | Treatment Chemistry | No. of Washes | DP, Machine Dry | DP, Line Dry |
|---|---|---|---|---|---|
| 1 | R/F | F (35%) + SE (5%) + C (10%) | 1 | 3.5 | 2.7 |
| 2 | R/F | AR (6%) + C (1.5%) + CS (8%) + SE (2%) | 1 | 2.8 | 1.3 |
| 3 | R/F | Untreated | 1 | 2.4 | 1.6 |
| 4 | R/F | F (35%) + SE (5%) + C (10%) | 3 | 3.4 | 2.3 |
| 5 | R/F | AR (6%) + C (1.5%) + CS (8%) + SE (2%) | 3 | 2.5 | 1.2 |
| 6 | R/F | Untreated | 3 | 1.8 | 1.5 |
| 7 | R | F (35%) + SE (5%) + C (10%) | 1 | 4.8 | 3.3 |
| 8 | R | AR (6%) + C (1.5%) + CS (8%) + SE (2%) | 1 | 2.2 | 2.5 |
| 9 | R | Untreated | 1 | 1.2 | 2.8 |
| 10 | R | F (35%) + SE (5%) + C (10%) | 5 | 4.9 | 3.7 |
| 11 | R | AR (6%) + C (1.5%) + CS (8%) + SE (2%) | 5 | 3.1 | 3.0 |
| 12 | R | Untreated | 5 | 1.0 | 2.6 |
| 13 | L | F (35%) + SE (5%) + C (10%) | 2 | NA | 2.3 |
| 14 | L | AR (6%) + C (1.5%) + CS (8%) + SE (2%) | 2 | NA | 1.2 |
| 15 | L | Untreated | 2 | NA | 1.2 |

One of ordinary skill will appreciate that Samples 1, 4, 7, 10 and 13 are fabrics in accordance with the invention. Samples 1, 4, 7, 10 and 13 show durable press properties which exceed those of conventional aminoplast treated rayon-containing fabrics, Samples 2, 5, 8, 11 and 14, and untreated rayon-containing fabrics, Samples 3, 6, 9, 12 and 15. The fabrics in accordance with the invention display improved durable press properties whether machine-dried or line-dried.

EXAMPLE 10

Four samples of a rayon Challis fabric measuring 18×36 inches are padded with a treatment solution and run through squeeze rollers to provide the amount of treatment chemicals as indicated in Table 12. The treated fabric is applied to a pin frame and culed in an oven at the temperatures indicated. The pinned fabric is removed from the oven and then from the pin frame. The physical properties of the treated fabric are measured as shown in Table 12.

It is clear from Table 12 that increasing the amount of formaldehyde on the weight of the fabric (OWF) improves the DP value but reduces the strength of the fabric. This is also true with respect to the amount of shrinkage and the results show an entirely unexpected combination of DP and reduction in shrinkage.

EXAMPLE 11

Samples are prepared as in Example 10 using rayon flax fabric with the necessary amounts of chemicals to provide the OWF values shown in Table 13. The curing temperature is 300° and the dwell time is varied. The results are shown in Table 13.

EXAMPLE 12

Lenzing Lyocell rayon fabric is treated in accordance with the process of Example 10 to provide the amounts of chemicals OWF as indicated in Table 14. Table 14 shows the effectiveness of the process on Lyocell rayon.

EXAMPLE 13

A rayon and acetate fabric is treated in accordance with the process of Example 10 to provide the amounts of chemicals OWF as indicated in Table 15. Table 15 shows the effectiveness of the process on rayon acetate fabrics.

EXAMPLE 14

A 50/50 rayon/polyester fabric is treated in accordance with the process of Example 10 to provide the amounts of chemicals OWF as indicated in Table 16. Table 16 shows the effectiveness of the process on rayon/polyester fabrics.

TABLE 12

| Sample No. | CH2O % OWF | Cat LF % OWF | SM2112 % OWF | Urea % OWF | Cure/Time Deg F./Min | Tensile or Burst Strength | Tear or % Loss Burst Str. | Shrink 5 Wash WxF % | DP 5 Wash |
|---|---|---|---|---|---|---|---|---|---|
| 778 | 10.0 | 3.4 | 1.5 | 2.0 | 300/10 | 81.5 × 75.3 | 108.4 × 107.2 | 2.83 × +0.25 | 3.25 |
| 779 | 15.0 | 4.3 | 1.5 | 2.0 | 300/10 | 74.3 × 69.2 | 84.0 × 87.4 | 1.25 × +0.67 | 3.50 |
| 780 | 20.0 | 5.1 | 1.5 | 2.0 | 300/10 | 67.8 × 50.5 | 72.7 × 59.1 | 0.50 × +0.16 | 4.00 |
| 777 | Control | — | — | — | — | 86.7 × 77.2 | 74.5 × 59.1 | 18.25 × 8.42 | 1.00 |

TABLE 13

| Sample No. | CH2O % OWF | Cat LF % OWF | SM2112 % OWF | Urea % OWF | Cure 300° F./ Min | Tensile, Lb WxF | Tear, Oz, WxF | Shrink l-W WxF | DP 1-Wash |
|---|---|---|---|---|---|---|---|---|---|
| 959 | 15.0 | 4.3 | 1.5 | 1.0 | 10.0 | 107.0 × 71.0 | 128.2 × 95.5 | 0.17 × +0.91 | 3.50 |
| 960 | 15.0 | 4.3 | 1.5 | 1.0 | 7.5 | 111.7 × 70.0 | 119.9 × 100.9 | 0.42 × +0.75 | 3.50 |
| 961 | 15.0 | 4.3 | 1.5 | 1.0 | 5.0 | 117.5 × 77.2 | 138.4 × 119.0 | 0.83 × +0.50 | 3.25 |
| 962 | 15.0 | 4.3 | 1.5 | 1.0 | 2.5 | 124.5 × 83.8 | 183.5 × 146.1 | 2.00 × 0.33 | 3.0 |

TABLE 14

| Sample No. | CH2O % OWF | Cat LF % OWF | SM2112 % OWF | Urea % OWF | Cure/Time Deg F./Min | Tensile, Lb. WxF | Tear, Oz. WxF | Shrink 1-Wash WxF % | DP 1-Wash | Shrink 5-Wash WxF | DP 5-Wash |
|---|---|---|---|---|---|---|---|---|---|---|---|
| 945 | 15.0 | 4.3 | 1.5 | 1.0 | 280/10 | 87.0 × 49.7 | 105.0 × 67.1 | 0.42 × +0.17 | 4.0 | 0.17 × 0.65 | 3.50 |
| 946 | 15.0 | 4.3 | 1.5 | 1.0 | 300/10 | 76.8 × 34.7 | 68.2 × 51.5 | 0.00 × +0.17 | 4.0 | 0.25 × 0.50 | 3.50 |
| 947 | 15.0 | 4.3 | 1.5 | 1.0 | 300/10 | 74.6 × 42.0 | 86.22 × 54.9 | 0.17 × +0.17 | 4.0 | 0.17 × 0.50 | 4.00 |
| 948C | — | — | — | — | — | 120.8 × 80.8 | 60.5 × 37.7 | 2.92 × 2.00 | 1.0 | 4.00 × 1.25 | 1.00 |

TABLE 15

| Sample No. | Fabric and Color | CH2O % OWF | Cat LF % OWF | SM2112 % OWF | Urea % OWF | Cure/Time Deg F./ Min | Tensile, Lb. WxF | Tear Oz. WxF | Shrinkage 1-Wash WxF | DP 1-Wash | Shrinkage 5-Wash WxF | DP 5-Wash |
|---|---|---|---|---|---|---|---|---|---|---|---|---|
| 728 | R&A Tan Union | 15.0 | 4.3 | 1.5 | 1.0 | 300/10 | 44.7 × 22.0 | 64.3 × 44.7 | 1.92 × 0.17 | 4.00 | 2.83 × 0.42 | 3.50 |
| 728C | Control | — | — | — | — | — | 74.0 × 49.0 | 77.2 × 108.4 | 19.91 × 13.2 | 1.00 | 19.6 × 29.0 | <1.00 |
| 729 | R&A Tan Plaid | 15.0 | 4.3 | 1.5 | 1.0 | 300/10 | 41.3 × 23.5 | 76.8 × 41.8 | 1.25 × 0.58 | 3.75 | 1.92 × 1.25 | 3.50 |
| 729C | Control | — | — | — | — | — | 82.3 × 50.8 | 95.5 × 110.2 | 20.1 × 7.93 | 1.50 | 20.0 × 14.2 | 1.00 |
| 730 | R&A Tan Check | 15.0 | 4.3 | 1.5 | 1.0 | 300/10 | 47.7 × 22.7 | 72.2 × 51.1 | 1.00 × 2.00 | 3.50 | 1.25 × 2.42 | 3.25 |
| 730C | Control | — | — | — | — | — | 76.3 × 44.4 | 83.5 × 94.8 | 14.0 × 8.83 | 1.00 | 19.2 × 13.1 | 1.00 |
| 731 | R&A Pink Plaid | 15.0 | 4.3 | 1.5 | 1.0 | 300/10 | 42.2 × 23.5 | 85.8 × 58.2 | 1.58 × 2.75 | 3.25 | 3.00 × 3.58 | 3.00 |
| 731C | Control | — | — | — | — | — | 66.0 × 42.7 | 90.8 × 51.2 | 9.25 × 17.2 | <1.00 | 13.3 × 28.1 | <1.00 |
| 732 | R&A Charcoal Union | 15.0 | 4.3 | 1.5 | 1.0 | 300/10 | 39.0 × 22.7 | 72.2 × 46.3 | 1.75 × 0.50 | 5.00 | 2.42 × 0.33 | 5.00 |
| 732C | Control | — | — | — | — | — | 72.8 × 45.3 | 93.2 × 104.4 | 14.42 × 19.7 | 1.00 | 19.8 × 26.5 | <1.00 |
| 733 | R&A Grey Hounds-tooth | 15.0 | 4.3 | 1.5 | 1.0 | 300/10 | 41.5 × 22.7 | 68.4 × 22.7 | 0.67 × 3.83 | 3.25 | 1.25 × 5.00 | 3.40 |
| 733C | Control | — | — | — | — | — | 73.2 × 43.3 | 106.6 × 87.4 | 6.33 × 6.58 | 1.50 | 10.8 × 11.7 | 1.00 |

TABLE 15-continued

| Sample No. | Fabric and Color | CH2O % OWF | Cat LF % OWF | SM2112 % OWF | Urea % OWF | Cure/Time Deg F./ Min | Tensile, Lb. WxF | Tear Oz. WxF | Shrinkage 1-Wash WxF | DP 1-Wash | Shrinkage 5-Wash WxF | DP 5-Wash |
|---|---|---|---|---|---|---|---|---|---|---|---|---|
| 734 | R&A Black/ White Plaid | 15.0 | 4.3 | 1.5 | 1.0 | 300/10 | 40.0 × 27.8 | 67.1 × 58.7 | 1.50 × 3.00 | 5.00 | 1.92 × 4.17 | 5.00 |
| 734C | Control | — | — | — | — | — | 72.0 × 47.3 | 74.0 × 66.2 | 12.75 × 12.25 | 1.00 | 18.5 × 18.5 | 1.50 |

TABLE 16

| Sample No | CH2O % OWF | Cat LF % OWF | SM2112 % OWF | Urea % OWF | Cure/Time Deg F./Min | Tensile, Lb. WxF | Tear Oz. WxF | Shrinkage 1-Wash WxF | DP 1-Wash | Shrinkage 5-Wash WxF | DP 5-Wash |
|---|---|---|---|---|---|---|---|---|---|---|---|
| 714 | — | — | — | — | — | 73.5 × 54.0 | No Tear* | 3.33 × 5.67 | <1.00 | 3.33 × 7.25 | <1.00 |
| 715 | 8.0 | 2.8 | 1.5 | 1.0 | 300/10 | 55.0 × 36.5 | NT | 1.42 × 0.83 | 2.00 | 1.75 × 1.33 | 2.00 |
| 716 | 10.0 | 3.4 | 1.5 | 1.0 | 300/10 | 49.8 × 28.0 | NT | 1.25 × 0.92 | 2.00 | 1.33 × 0.92 | 2.00 |
| 717 | 12.0 | 3.8 | 1.5 | 1.0 | 300/10 | 42.0 × 38.0 | NT | 0.83 × 0.58 | 3.00 | 0.58 × 1.50 | 3.00 |
| 718 | 15.0 | 4.3 | 1.5 | 1.0 | 300/10 | 40.2 × 28.3 | NT | 0.83 × 0.92 | 5.00 | 1.08 × 1.33 | 5.00 |
| 719 | 20.0 | 5.1 | 1.5 | 1.0 | 300/10 | 36.0 × 27.0 | NT | 0.92 × 0.92 | 5.00 | 0.83 × 0.92 | 5.00 |

*Note:
Tear value exceed the capacity of the Elmendorff Tester.
**Note:
DP is based on reduction of the waffle effect, not on wrinkling as there is none This 50/50 polyester/rayon fabric previously could not be sold as a washable fabric. These fabrics are not an intimate blend of rayon and polyester fibers, but are woven such that some of the areas are 100% polyester and others are 100% rayon. The rayon shrinks on water washing, the polyester does not. The difference in this shrinkage of the two fibers causes severe puckering of the fabric, making it resemble a waffle. This fabric is normally sold as a "dry-cleanable" fabric but when treated in accordance with the present process results in a new product which is washable.

EXAMPLE 15

A rayon and flax (85/15) fabric is treated in accordance with the process of Example 10 to provide the amounts of chemicals OWF as indicated in Table 17. Table 17 shows the effectiveness of different embodiments of the process on a rayon containing fabric.

The results in Table 17 show the effectiveness of formaldehyde and catalyst to achieve results which surpasses the industry strength standards and produce a DP value of 3.5. The results in Table 17 also show that rayon containing fabrics treated with formaldehyde and catalyst achieve a fabric which surpasses the industry strength standards, and produces a DP value of 3.5. This fabric would be acceptable to the industry. Table 17 also shows that when silicone elastomer is added to the formaldehyde and catalyst, considerably higher strengths are realized and a DP of 4.00 is obtained. Adding urea alone to the formaldehyde and catalyst results in higher tensile strength, but lower tear strength than obtained with the silicone, as would be expected as the urea makes the fabric somewhat stiffer. The results, however, are better than with the formaldehyde and catalyst alone. DP is not improved by the addition of urea. In a preferred embodiment, formaldehyde, catalyst, silicone SM2112 and urea are used and overall improved results are obtained in both tensile and tear strength. The DP is again boosted to 4.00 by the presence of the silicone. Shrinkage was remarkably constant throughout all samples, showing extensions of approximately the same magnitude as compared to shrinkage of 6.42% on the untreated control.

TABLE 17

| Sample No. | CHWO % OWF | Cat LF % OWF | SM2112 % OWF | Urea % OWF | Tensile Lb WxF | Tear Oz WxF | Shrink 1-Wash WxF | DP** 1-Wash |
|---|---|---|---|---|---|---|---|---|
| 969 | 18.0 | 5.4 | — | — | 69.5 × 50.5 | 53.1 × 41.8 | +0.33 × +1.08 | 3.50 |
| 970 | 18.0 | 5.4 | 1.5 | — | 76.2 × 49.8 | 87.4 × 74.5 | +0.58 × +1.00 | 4.00 |
| 971 | 18.0 | 5.4 | — | 1.0 | 77.5 × 59.3 | 61.0 × 55.8 | +0.50 × +1.33 | 3.50 |
| 972 | 18.0 | 5.4 | 1.5 | 1.0 | 85.0 × 59.8 | 97.8 × 76.1 | +0.41 × +1.17 | 4.00 |
| 973 Control | — | — | — | — | 93.8 × 68.5 | 72.2 × 65.0 | 6.42 × 1.91 | 1.00 |

Note:
Shrinkage with a "plus" sign indicates that the fabric extended, did not get smaller.

EXAMPLE 16

Two rayon fabrics are pressed in a hot head press at 350° F. for 15 seconds. The pressing causes a severe shine in both fabrics, but it was more noticeable in the black butcher linen. Pressing after these fabrics had been treated with the treatment of the present invention produced no noticeable shine as summarized in the following Table 18.

TABLE 18

| Fabric/Color | Untreated Unpressed | Untreated Pressed | Treated Pressed |
|---|---|---|---|
| Rayon Twill/White | Slight Shine* | High Shine | Slight Shine |
| Rayon Linen/Black | No Shine | High Shine | No Shine |

*The slight shine in the original fabric is due to the bright rayon fibers used. The pressing increases the shine, but with the treatment of the present invention, the fabric does not show the increased shine after pressing and looks like the original fabric.

Shining is a serious problem with rayon fabrics, not only due to pressing by the consumer but also in the processing mill where glazed spots appear where the fabric touches hot metal. Rayon fibers exhibit molecular movement under heat and pressure, thus deforming the fibers and making flat spots. If enough flat spots are produced, the fiber begins to act like a mirror and instead of reflecting light in all directions, it reflects light in one direction, causing a bright "shine." If severe enough, as in the case of the black fabric, a total change of shade occurs. Treatment in accordance with the present invention either retards shining or eliminates it altogether.

The examples and specific embodiments set forth herein are for illustrative purposes only and are not intended to limit the scope of the fabrics and methods of the invention. Additional embodiments and modifications within the scope of the claimed invention will be apparent to one of ordinary skill in the art. Accordingly, the scope of the present invention shall be considered in the terms of the following claims, and is understood not to be limited to the details, examples or the methods described in the specification.

What is claimed is:

1. Fabric comprising rayon fibers and exhibiting, after the fabric has been aqueous laundered at least one time, (a) changes in dimension in length and in width of less than about 5% each, (b) a durable press value of at least about 2.5, and (c) a water absorbency time of less than about 100 seconds, wherein the fabric is provided with a silicone elastomer and is unresinated.

2. Fabric according to claim 1, exhibiting, after the fabric has been aqueous laundered at least one time, a length shrinkage and a width shrinkage of less than about 4% each.

3. Fabric according to claim 1, further exhibiting, after the fabric has been aqueous laundered at least one time a water absorbency time of less than about 80 seconds.

4. Fabric according to claim 3, further exhibiting, after the fabric has been aqueous laundered at least one time a water absorbency time of less than about 30 seconds.

5. Fabric according to claim 1, comprising about 100%, by weight, rayon fibers.

6. Fabric according to claim 1, which, after the fabric has been aqueous laundered and machine tumbled dried at least one time, exhibits (a) changes in dimension in length and in width of less than about 5% each, (b) a durable press value of at least about 2.5.

7. Fabric according to claim 1, having a cross-linked formaldehyde treatment.

8. Fabric according to claim 1, exhibiting, after the fabric has been aqueous laundered 5 times, (a) changes in dimension in length and in width of less than about 5% each, and (b) a durable press value of at least about 2.5.

9. Fabric according to claim 8, further exhibiting, after the fabric has been aqueous laundered 5 times, a water absorbency time of less than about 80 seconds.

10. Fabric according to claim 1, exhibiting, after the fabric has been aqueous laundered 25 times, (a) changes in dimension in length and in width of no greater than about 6% each, and (b) a durable press value of at least about 5.

11. Fabric according to claim 1, exhibiting, after the fabric has been aqueous laundered at least one time, (a) changes in dimension in length and in width of less than about 4% each, (b) a durable press value of at least about 3, (c) a water absorbency time of less than about 100, (d) a softness value of at least about 8, and (e) a KES MIU value of no greater than about 1.3.

12. Fabric comprising rayon fibers and exhibiting, after the fabric has been aqueous laundered at least one time, (a) changes in dimension in length and in width of less than about 5% each, (b) a durable press value of at least about 3, and (c) a water absorbency time of less than about 100 seconds, wherein the fabric is provided with a silicone elastomer.

13. Fabric according to claim 3, exhibiting, after the fabric has been aqueous laundered at least one time, a softness value of at least about 8.

14. Fabric according to claim 13, exhibiting, after the fabric has been aqueous laundered at least one time, a KES MIU value of no greater than about 1.3.

15. Fabric according to claim 12, comprising rayon fibers and cellulosic fibers other than rayon fibers and exhibiting, after the fabric has been aqueous laundered at least one time, (a) a length shrinkage and a width shrinkage of less than about 4% each, and (b) a durable press value of at least about 3.5.

16. Fabric according to claim 15, wherein the cellulosic fibers other than rayon fibers are selected from the group consisting of cotton, flax, linen, acetate, triacetate and mixtures thereof.

17. Fabric according to claim 12, comprising synthetic fibers and no less than about 50%, by weight, rayon fibers and exhibiting, after the fabric has been aqueous laundered at least one time, (a) a length shrinkage and a width shrinkage of less than about 2% each, and (b) a durable press value of at least about 4.

18. Fabric according to claim 12, comprising synthetic fibers and no less than about 65%, by weight, rayon fibers and exhibiting, after the fabric has been aqueous laundered at least one time, (a) a length shrinkage and a width shrinkage of less than about 3% each, and (b) a durable press value of at least about 3.5.

19. Fabric according to claim 12, wherein the fabric is unresinated.

20. A method of laundering a fabric comprising rayon fibers comprising the steps of (a) aqueous laundering and (b) drying, wherein the fabric is provided with a silicone elastomer and is unresinated, and further wherein the fabric exhibits, after at least one cycle of aqueous laundering and drying, changes in dimension in length and in width of less than about 5% each.

21. A method according to claim 20, wherein the step of drying comprises line drying.

22. A method according to claim 21, wherein the fabric exhibits, after at least one cycle of aqueous laundering and drying, a durable press value of at least about 2.5.

23. A method according to claim 20, wherein the step of drying comprises machine tumble drying.

24. A method according to claim 20, wherein the fabric comprises at least about 50%, by weight, rayon fibers.

25. A method according to claim 20, wherein the fabric exhibits, after at least one cycle of aqueous laundering and drying, (a) changes in dimension in length and in width of less than about 4% each, and (b) a durable press value of at least about 3.5.

26. A method according to claim 20, wherein the fabric further exhibits, after at least one cycle of aqueous laundering and drying, a water absorbency time of less than about 100 seconds.

27. A method according to claim 20, wherein the fabric exhibits, after 5 cycles of aqueous laundering and drying, (a) a length shrinkage and a width shrinkage of less than about 5% each, and (b) a durable press value of at least about 2.5.

28. A method according to claim 20, wherein the aqueous laundering step comprises laundering the fabric with an aqueous solution at a temperature in the range of from about 60° F. to about 145° F.

29. Treated fabric comprising rayon fibers which after at least one aqueous laundering exhibits, as compared to untreated fabric having the same fiber composition, (a) changes in dimension in length and in width which are each at least about 25% less than that exhibited by the untreated fabric, (b) a durable press value at least about 0.5 unit greater than that exhibited by the untreated fabric, and (c) a water absorbency time of less than about 100 seconds, wherein the treated fabric is provided with silicone elastomer and is unresinated.

30. Treated fabric according to claim 28, which after at least one aqueous laundering exhibits, as compared to untreated fabric having the same fiber composition, a change in dimension in length and in width which are each at least about 35% less than that exhibited by the untreated fabric.

31. Treated fabric according to claim 29, which after at least one aqueous laundering exhibits, as compared to untreated fabric having the same fiber composition, a durable press value at least about 0.7 unit greater than that exhibited by the untreated fabric.

32. Treated fabric according to claim 29, having a cross-linked formaldehyde treatment.

33. Treated fabric according to claim 29, which after 25 aqueous laundering exhibits, as compared to untreated fabric having the same fiber composition, (a) changes in dimension in length and in width which are each at least about 25% less than that exhibited by the untreated fabric, and (b) a durable press value at least about 0.5 unit greater than that exhibited by the untreated fabric.

34. Treated fabric according to claim 29, which after at least one aqueous laundering exhibits, as compared to untreated fabric having the same fiber composition, a change in dimension in length and in width which are each at least about 50% less than that exhibited by the untreated fabric.

35. Fabric comprising rayon fibers and exhibiting, after the fabric has been aqueous laundered at least one time, (a) changes in dimension in length and in width of less than about 8% each, (b) a durable press value of at least about 3.5, and (c) a water absorbency time of less than about 100 seconds, wherein the fabric is provided with a silicone elastomer.

36. Fabric according to claim 35, further exhibiting, after the fabric has been aqueous laundered at least one time, a softness values of at least about 8.

37. Fabric according to claim 35, further exhibiting, after the fabric has been aqueous laundered at least one time, a KES MIU value of no greater than about 1.3.

38. Fabric according to claim 35, exhibiting, after the fabric has been aqueous laundered 5 times, (a) changes in dimension in length and in width of less than about 5% each, (b) a durable press value of at least about 2.5, and (c) a water absorbency time of less than about 100 seconds.

39. Fabric according to claim 38, further exhibiting, after the fabric has been aqueous laundered at least 25 times, a durable press value of at least about 2.5, and total shrinkage no greater than about 12%.

40. Fabric according to claim 35, comprising at least about 50%, by weight, rayon fibers.

41. Fabric according to claim 35, wherein the fabric comprises a woven fabric having a filling tensile strength of at least about 25 pounds.

42. Fabric according to claim 41, wherein the woven fabric further has a filling tear strength of at least about 1 pound.

43. Fabric according to claim 35, wherein the fabric comprises a knitted fabric having a burst strength of at least about 80 pounds.

44. Fabric according to claim 35, wherein the fabric is unresinated.

45. Fabric comprising rayon fibers, wherein the fabric is provided with silicone elastomer and is selected from the group consisting of (a) fabrics comprising no less than about 50% rayon fibers and exhibiting, after the fabric has been aqueous laundered at least one time, a total shrinkage of less than about 6% and a durable press value of at least about 3.5, (b) fabrics comprising no less than about 85% rayon fibers and exhibiting, after the fabric has been aqueous laundered at least one time, a total shrinkage of less than about 10% and a durable press value of at least about 3, and (c) fabrics comprising about 100% rayon fibers and exhibiting, after the fabric has been aqueous laundered at least one time, a total shrinkage of no greater than about 12% and a durable press value of at least about 3.

46. Fabric according to claim 45, comprising flax fibers and no less than about 85% rayon fibers, and exhibiting, after the fabric has been aqueous laundered at least one time, less than about 6% total shrinkage.

47. Fabric according to claim 45, comprising polyester fibers and no less than about 50% rayon fibers, and exhibiting, after the fabric has been aqueous laundered at least one time, less than about 3% total shrinkage.

48. Fabric according to claim 45, comprising cotton fibers and no less than about 50% rayon fibers, and exhibiting, after the fabric has been aqueous laundered at least one time, less than about 5% total shrinkage.

49. Fabric according to claim 45, comprising cross-linked rayon fibers.

50. Fabric comprising about 50% rayon fibers and about 50% acetate fibers, and exhibiting after the fabric has been aqueous laundered at least one time, a total shrinkage of less than about 40%.

51. Fabric according to claim 49, further exhibiting after the fabric has been aqueous laundered at least one time, a durable press value of at least 2.5.

52. Fabric comprising rayon fibers, wherein the fabric is provided with silicone elastomer, is unresinated, and exhibits, after the fabric has been aqueous laundered at least one time, (a) a total shrinkage of less than about 10%, (b) a durable press value of at least about 2.5, and (c) a water absorbency time of less than about 100 seconds.

53. Fabric comprising rayon fibers, wherein the fabric is provided with silicone elastomer, is unresinated, and is selected from the group consisting of (a) fabrics comprising no less than about 50% rayon fibers and exhibiting, after the fabric has been aqueous laundered at least one time, changes in dimension in length and width of less than about 6% each and a durable press value of at least about 3.5, (b) fabrics comprising no less than about 85% rayon fibers and exhibiting, after the fabric has been aqueous laundered at least one time, changes in dimension in length and width of less than about 10% each and a durable press value of at least about 3, and (c) fabrics comprising about 100% rayon fibers and exhibiting, after the fabric has been aqueous laundered at least one time, changes in dimension in length and width of no greater than about 12% each and a durable press value of at least about 3.

* * * * *